US009912069B2

(12) United States Patent
Alu et al.

(10) Patent No.: US 9,912,069 B2
(45) Date of Patent: Mar. 6, 2018

(54) DUAL-POLARIZED, BROADBAND METASURFACE CLOAKS FOR ANTENNA APPLICATIONS

(71) Applicant: Board of Regents, The University of Texas System, Austin, TX (US)

(72) Inventors: Andrea Alu, Austin, TX (US); Jason Soric, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 327 days.

(21) Appl. No.: 14/844,243

(22) Filed: Sep. 3, 2015

(65) Prior Publication Data

US 2016/0111782 A1 Apr. 21, 2016

Related U.S. Application Data

(60) Provisional application No. 62/066,490, filed on Oct. 21, 2014.

(51) Int. Cl.
*H01Q 15/00* (2006.01)
*H01Q 1/52* (2006.01)
*H01Q 9/04* (2006.01)

(52) U.S. Cl.
CPC ..... *H01Q 15/0086* (2013.01); *H01Q 1/521* (2013.01); *H01Q 9/0407* (2013.01)

(58) Field of Classification Search
CPC ..... H01Q 5/20; H01Q 5/48; H01Q 9/0407; H01Q 9/0442; H01Q 15/00
See application file for complete search history.

(56) References Cited

U.S. PATENT DOCUMENTS

2010/0110559 A1* 5/2010 Cai ..... F41H 3/00 359/642
2010/0156573 A1* 6/2010 Smith ..... H01P 3/081 333/239

(Continued)

FOREIGN PATENT DOCUMENTS

WO 2014182398 A1 11/2014

OTHER PUBLICATIONS

Search Report and Written Opinion for International Application No. PCT/US15/48264 dated Nov. 27, 2015, pp. 1-9.

(Continued)

*Primary Examiner* — Dameon E Levi
*Assistant Examiner* — Jennifer F Hu
(74) *Attorney, Agent, or Firm* — Robert A. Voigt, Jr.; Winstead, P.C.

(57) ABSTRACT

A communication system that reduces the mutual influence of antennas operating in similar or different frequency bands. The communication system includes a first and a second antenna operating in a first and a second frequency band, respectively, and placed in close proximity to each other. The first antenna is covered by a conformal mantle metasurface with anti-phase scattering properties thereby cancelling the scattering in the second frequency band. The conformal mantle metasurface consists of a patterned metallic sheet comprising slits both in an azimuthal and a vertical direction to reduce both vertical and horizontal polarization scattering. When the first antenna is a low-band dipole antenna and when the second antenna is a high-band dipole antenna, the conformal mantle metasurface reduces the low-band blockage without disrupting the performance of both antennas in terms of radiation pattern and impedance matching.

13 Claims, 20 Drawing Sheets

(56) References Cited

U.S. PATENT DOCUMENTS

2010/0283705 A1* 11/2010 Achour ..... H01Q 21/065 343/844
2012/0154793 A1* 6/2012 Pryce ..... G01N 21/3581 356/51
2012/0194399 A1* 8/2012 Bily ..... H01Q 13/28 343/772
2012/0319798 A1* 12/2012 Cohen ..... H01Q 21/205 333/135
2014/0085693 A1* 3/2014 Mosallaei ..... G02B 1/002 359/107
2014/0126322 A1* 5/2014 Cipolla ..... G10K 11/18 367/1
2014/0178003 A1* 6/2014 Young ..... G02B 6/34 385/37
2015/0130563 A1 5/2015 Cohen
2015/0234100 A1* 8/2015 Lu ..... G02B 17/008 359/850
2016/0087342 A1* 3/2016 Alu ..... H01Q 15/148 342/4
2016/0111782 A1* 4/2016 Alu ..... H01Q 1/521 343/745

OTHER PUBLICATIONS

Monti et al., "Overcoming Mutual Blockage Between Neighboring Dipole Antennas Using a Low-Profile Patterned Metasurface," IEEE Antennas and Wireless Propagation Letters, vol. 11, 2012, pp. 1414-1417.
Walia et al., "Flexible Metasurfaces and Metamaterials: A Review of Materials and Fabrication Processes at Micro- and Nano- Scales," Applied Physics Reviews 2, 011303, Mar. 2015, pp. 011303-1 to 011303-14.
International Preliminary Report on Patentability for International Application No. PCT/US2015/048264 dated May 4, 2017, pp. 1-8.
Monti et al., "Anisotropic Mantle Cloaks for TM and TE Scattering Reduction," IEEE Transactions on Antennas and Propagation, vol. 63, Issue 4, Apr. 1, 2015, pp. 1775-1788.
Soric et al., "Multiband and Wideband Bilayer Mantle Cloaks," IEEE Transactions on Antennas and Propagation, vol. 63, Issue 7, Jul. 1, 2015, pp. 3235-3240.

* cited by examiner

500

DUAL-POLARIZED, BROADBAND METASURFACE CLOAKS FOR ANTENNA APPLICATIONS

GOVERNMENT INTERESTS

This invention was made with government support under Grant No. ECCS-0953311 awarded by the National Science Foundation. The U.S. government has certain rights in the invention.

TECHNICAL FIELD

The present invention relates generally to cloaking, and more particularly to utilizing metasurface cloaks to reduce the mutual influence of antennas operating in the same frequency band or in different frequency bands as well as providing new venues to broaden the bandwidth, achieve nearly perfect invisibility, wideband tenability or multiband cloaking of passive metasurface cloaks and to operate in dual-polarization.

BACKGROUND

Significant interest in reducing the antenna blockage in high-complexity or crowded communication systems has been recently highlighted by several authors. In this context, reducing the electromagnetic presence of an antenna or a sensor by tailoring its geometry, loading, or cover has been explored and demonstrated in several examples. Recently, it has been shown that ultrathin impedance surfaces may be applied to cover dielectric and conductive objects in order to suppress their overall scattering signature at the frequency of interest. These ultrathin surfaces may significantly reduce the total integrated scattering cross-section (SCS) of targets of moderate size ($2a \leq \lambda$), where a is the cross-sectional radius and $\lambda$ is the free-space wavelength. For conducting objects, the bandwidth and suppression level of such "mantle cloaks" is mainly dependent on the conformability of the cover to its target, where more conformal designs lead to a stronger scattering suppression (>15 dB) over a narrow bandwidth (~3%). Conversely, covers with a larger separation from the target, may achieve a more shallow suppression (~5 dB) up to 30% fractional bandwidths. A key feature of the scattering cancellation technique is the ability of the cloaked object to interact with the background region rather than being isolated as in other approaches to cloaking. These features are ideally suited for antenna applications, including blockage reduction from passive obstacles, elimination of the mutual coupling between closely spaced antennas, and the realization of low-visibility receiving antennas for sensing and monitoring applications. These electrically transparent antennas and sensors may be of great interest for tomography, imaging, and energy harvesting, in addition to exciting applications in crowded communication systems.

However, there is not currently a means for utilizing such mantle cloaks in realizable antenna systems.

BRIEF SUMMARY

In one embodiment of the present invention, a communication system comprises a first antenna radiating in a first frequency band, where the first antenna is covered by a conformal mantle metasurface with anti-phase scattering properties. The communication system further comprises a second antenna radiating in a second frequency band, where the conformal mantle metasurface is a patterned metallic sheet comprising an array of rectangular patches formed by slits both in an azimuthal and a vertical direction aimed at reducing both vertical and horizontal polarization scattering and where the conformal mantle metasurface is configured to cancel scattering in the second frequency band.

In another embodiment of the present invention, a communication system comprises a first antenna radiating in a first frequency band, where the first antenna is covered by a conformal mantle metasurface with anti-phase scattering properties. The communication system further comprises a second antenna radiating in a second frequency band, where the conformal mantle metasurface is a horizontal-strip capacitive surface and where the conformal mantle metasurface is configured to cancel scattering in the second frequency band.

In a further embodiment of the present invention, a communication system comprises a first antenna radiating in a first frequency band, where the first antenna is covered by a conformal mantle metasurface with anti-phase scattering properties. The communication system further comprises a second antenna radiating in a second frequency band, where the conformal mantle metasurface is characterized by a rectangular unit-cell with horizontal and vertical slits to exhibit a negative value of a surface reactance for transverse-magnetic and transverse-electric polarization, respectively, and where the conformal mantle metasurface is configured to cancel scattering in the second frequency band.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

Figure 1:
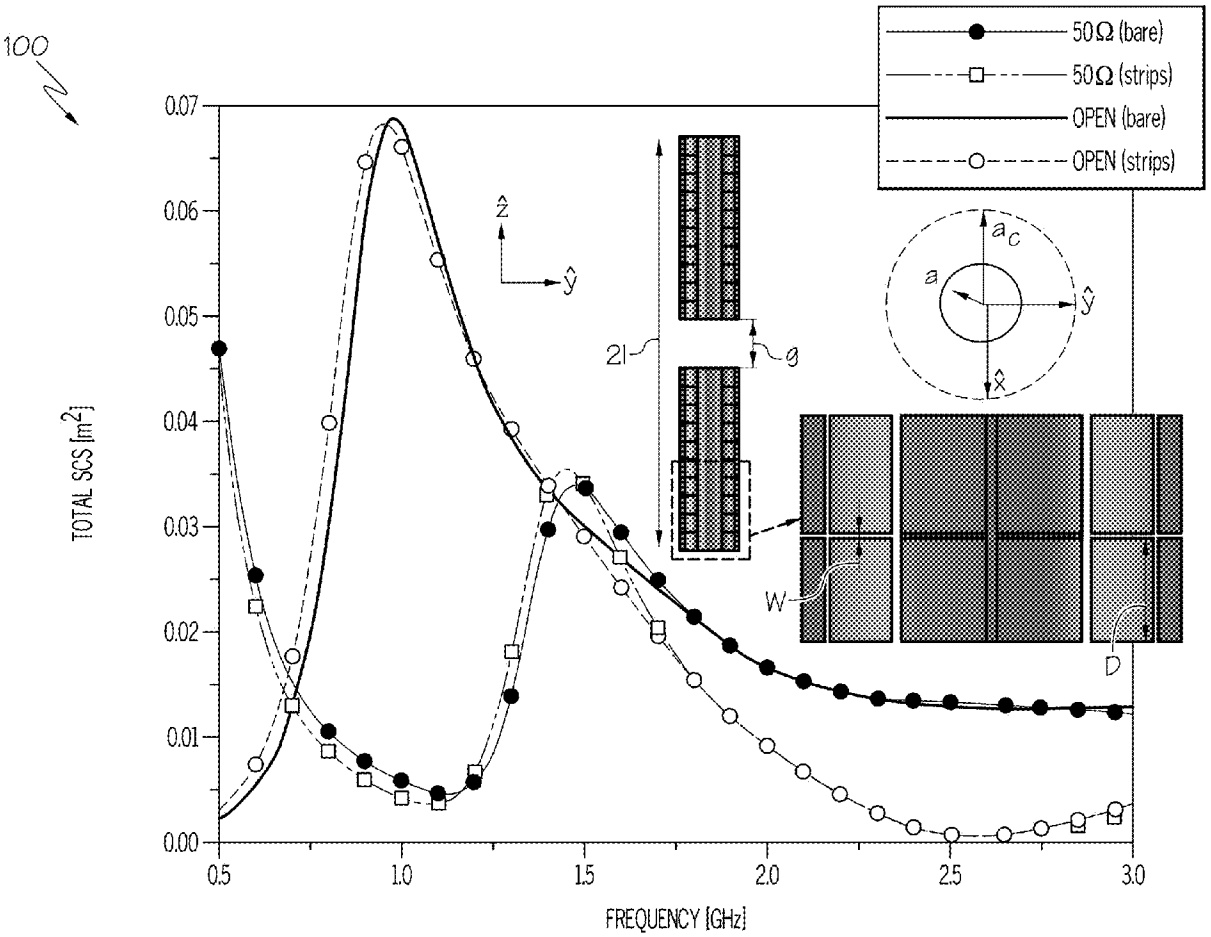
FIG. 1 is a graph illustrating the total scattering cross-section (SCS) for the open-circuit and loaded low-band (LB) dipole across the frequency range of interest under the dominant vertical polarization (V-pol) excitation in accordance with an embodiment of the present invention.

While the following discusses antennas herein in connection with dipoles, the principles of the present invention may be applied to other types of antennas, such as patch antennas, satellite antennas, parabolic dishes, horns, etc. A person of ordinary skill in the art would be capable of applying the principles of the present invention to such implementations. Further, embodiments applying the principles of the present invention to such implementations would fall within the scope of the present invention.

As stated above in the Background section, significant interest in reducing the antenna blockage in high-complexity or crowded communication systems has been recently highlighted by several authors. In this context, reducing the electromagnetic presence of an antenna or a sensor by tailoring its geometry, loading, or cover has been explored and demonstrated in several examples. Recently, it has been shown that ultrathin impedance surfaces may be applied to cover dielectric and conductive objects in order to suppress their overall scattering signature at the frequency of interest. These ultrathin surfaces may significantly reduce the total integrated scattering cross-section (SCS) of targets of moderate size ($2a\leq\lambda$), where a is the cross-sectional radius and $\lambda$ is the free-space wavelength. For conducting objects, the bandwidth and suppression level of such "mantle cloaks" is mainly dependent on the conformability of the cover to its target, where more conformal designs lead to a stronger scattering suppression (>15 dB) over a narrow bandwidth (~3%). Conversely, covers with a larger separation from the target, may achieve a more shallow suppression (~5 dB) up to 30% fractional bandwidths. A key feature of the scattering cancellation technique is the ability of the cloaked object to interact with the background region rather than being isolated as in other approaches to cloaking. These features are ideally suited for antenna applications, including blockage reduction from passive obstacles, elimination of the mutual coupling between closely spaced antennas, and the realization of low-visibility receiving antennas for sensing and monitoring applications. These electrically transparent antennas and sensors may be of great interest for tomography, imaging, and energy harvesting, in addition to exciting applications in crowded communication systems. However, there is not currently a means for utilizing such mantle cloaks in realizable antenna systems.

As discussed herein, the principles of the present invention provide a means for designing mantle cloaks that are optimally designed for communication systems, such as antenna systems. It is envisioned that the antennas discussed herein operate over a narrow or wide frequency band and are covered by suitable ultrathin covers that may strongly reduce the blockage effects of nearby antennas operating in different frequency bands. These concepts apply the inherently non-resonant scattering cancellation technique explored in the past to practically realizable antenna systems. In such applications, tradeoffs are generally necessary in terms of bandwidth, efficiency, overall scattering suppression and other specific requirements for the application of interest. Yet, it is demonstrated herein that the mantle cloaking technique offers unique features for the purposes at hand, and large flexibility to antenna designers. Designs are introduced herein that can overcome the bandwidth limitations generally associated with metamaterials and metasurfaces. Furthermore, the limitations arising when antennas are placed in close proximity, including polarization coupling and bandwidth limitations, are addressed herein. Finally, near- and far-field experiments are shown validating the proposed cloaking technique of the present invention for realistic antenna configurations.

It is noted for clarity that the technique of the present invention is fundamentally different from radar cross section (RCS) reduction or low-observability stealth techniques; namely, the scattering cancellation technique herein achieves significant scattering reduction at all angles, also in the forward direction, which is particularly relevant in the context of antenna communications. Resistively loaded absorbing surfaces composed by one or more layers are well-known to reduce the monostatic backscattering of targets, over large bandwidth, which is essentially a free-space matching problem. On the contrary, the scattering cancellation method discussed and demonstrated herein does not rely on wave absorption (which necessarily increases the forward scattering and shadow consistent with the optical theorem), but it instead designs a surface with anti-phase scattering properties compared to the one of the bare antenna to be cloaked. As a result, the scattered fields are nearly cancelled even in the very near-field, and the incident fields can pass through the obstructing antenna with low blockage. For the antenna applications discussed herein, this non-resonant scattering cancellation approach may be leveraged to significantly improve antenna and communication platforms in crowded environments, by reducing the presence of obstructing antennas working at various bands of interest yet without affecting their ability to transmit signals.

Metasurface Covers for Antenna Applications

An antenna placed in close proximity to another antenna or scatterer is well known to suffer from unwanted interference, perturbations on its radiation pattern, and detrimental mutual coupling. It is shown herein that suitably designed cloaks may be used to minimize these effects. The following description focuses on the problem in which a high-band (HB) antenna is placed very close to a larger low-band (LB) antenna. This is a situation of common interest in multiband antenna configurations, e.g., for cellular communication systems. The need for compact antenna arrays typically requires that these different antenna elements are placed in close proximity to each other, significantly affecting their radiation properties.

In a typical scenario of interest, a HB antenna (1.7-2.69 GHz) is placed very close to a LB antenna (0.69-0.90 GHz), and they both independently radiate in the two frequency bands of interest. It is expected that either antenna may act as a partial reflector in the other antenna band thereby redirecting the radiation pattern of the antenna network. Here it is shown that, when the blocking LB antenna is covered by an optimal conformal mantle metasurface $Z_S$, tailored to cancel the dominant scattering in the high-band, the HB antenna does not feel the presence of the neighboring element, and radiates as if isolated. On the contrary, typically the LB antenna is weakly affected by the HB antenna presence, due to its small electrical size, being able to radiate well in the low-band.

In recent papers, it has been theoretically and experimentally shown that an object may be efficiently cloaked using an ultrathin surface for plane wave (uniform phase) excitation. Analytical and numerical designs have been shown to be accurate for dielectric and conductive finite-length rods in free-space, and to be also applicable to non-uniform Gaussian wavefronts in the near-field of the target. Some difficulties do arise when the same cloak, optimized for normally-incident plane waves, is excited at different angles, for which the optimal cloaking frequency can shift. However, this frequency shift has been shown to be small, depending on the incident polarization, and it depends on the inherent spatial dispersion of thin FSS layers or metasurfaces. Dielectric layers may be used to improve the angular stability of such covers; however, the following description considers air-backed covers for their simplicity, low cost, low loss, and light weight realization.

Vertical Polarized Mantle Covers Under Plane Wave Excitation

Consider a LB dipole of length $2l=0.69\lambda_l$, diameter $2a=0.04\lambda_l$, with a feed gap $g=0.08\lambda_l$, where $\lambda_l$ is the central LB wavelength at 800 MHz, as in the inset of FIG. 1. FIG. 1 is a graph 100 illustrating the total scattering cross-section (SCS) for the open-circuit and loaded LB dipole across the frequency range of interest in accordance with an embodiment of the present invention. Both bare and covered dipoles are shown for a vertically polarized plane-wave excitation $$(E^{inc} = \hat{z}E_0 e^{j(\omega t - k_0 y)}).$$

FIG. 1 illustrates the total SCS for 50Ω-loaded and open-circuit LB dipoles under plane-wave excitation, which is defined as the total integrated bistatic scattered power at all angles for a particular excitation. First, the SCS is compared between loaded and unloaded LB antennas across a broad bandwidth. A clear resonance is seen in FIG. 1 near 970 MHz with no significant dependence on the loading condition. Therefore, only the structural scattering of the LB element needs to be considered for the cover design, and rigorous Mie theory may be applied to the obstructing open circuit LB dipole.

A horizontal-strip capacitive surface is first considered to reduce the scattering of the antenna, with dimensions D=11.6 mm, w=0.3 mm, and $a_c$=18.0 mm, which can provide an optimized surface impedance $Z_S=-j282\Omega$ able to suppress the scattering at the target frequency 2.7 GHz (as compared to $Z_S=-j249\Omega$ calculated from Mie theory using the dominant omnidirectional electric scattering mode). For the surface impedance design, the present invention used:

$$Z_s = -j\frac{\pi}{2\omega\varepsilon_0 D\ln\left[\csc\left(\frac{\pi w}{2D}\right)\right]}. \quad (1)$$

In EQ (1), it is assumed that the cover is lossless, due to the high conductivity of metals in the radio-frequency range considered herein. If necessary, losses may be considered by including a series lumped resistor in EQ (1), which depends on the material conductivity and metafilm geometry. In FIG.

1, only the vertical polarization (V-pol) is considered, which corresponds to an electric field polarized along the dipole axis $$(E^{inc} = \hat{z}E_0 e^{j(\omega t - k_0 y)}),$$

while the horizontal polarization (H-pol) is orthogonal to it at normal incidence, and it has a smaller interaction for a thin vertical dipole.

The horizontal strip cover considered in this first geometry is formed by opening thin air gaps along the azimuthal direction ($\hat{\phi}$) in a uniform copper shell. In this design, no gaps are present in the longitudinal direction, as opposed to the patch array schematically shown in the inset of FIG. 1, which will be useful for dual-polarization response. These thin slits cause an electric field discontinuity at the surface providing an effective capacitive response, following EQ (1). The proposed radius of the cover, which is significantly larger than the rod, is ideal to increase the bandwidth of operation using a single-layer cover. As seen in FIG. 1, the scattering is indeed largely reduced in the HB window, and the fractional bandwidth for 10 dB scattering suppression is 14%, with a maximum suppression of 13.5 dB at 2.56 GHz.

Figure 2:
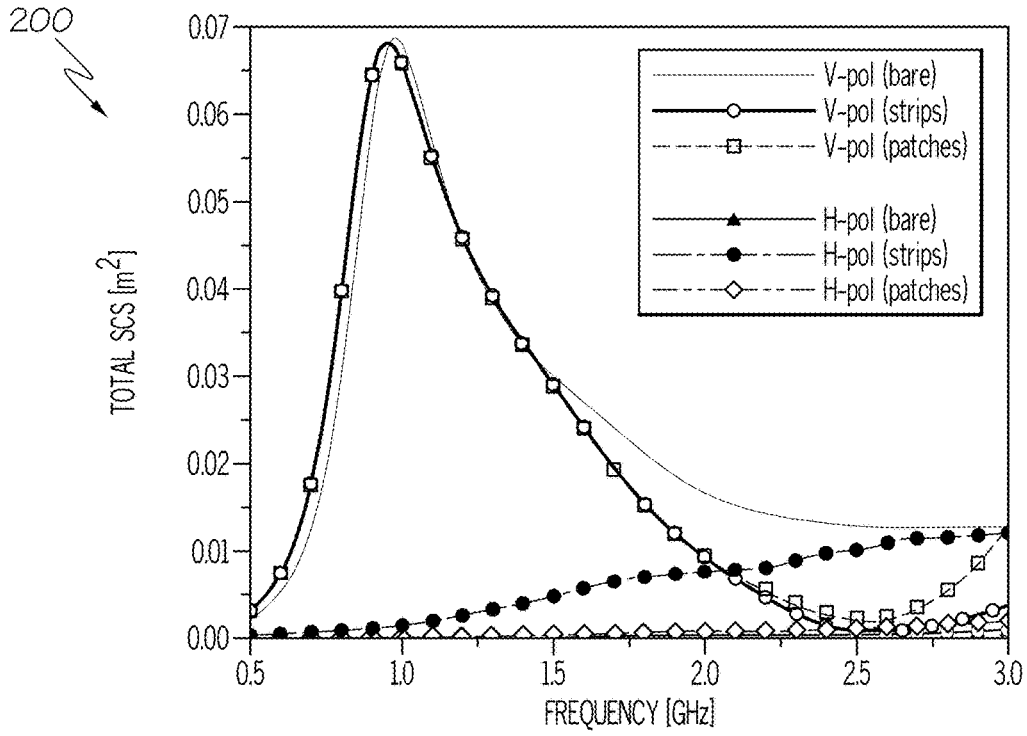
FIG. 2 is a graph illustrating the total SCS for the open-circuit LB dipole under dual-polarized excitation (vertical and horizontal) for two different metasurfaces in accordance with an embodiment of the present invention.

In FIG. 2, the SCS dispersion is considered for excitation with both polarizations. FIG. 2 is a graph 200 illustrating the total SCS for the open-circuit LB dipole under dual-polarized excitation (vertical and horizontal) for two different metasurfaces in accordance with an embodiment of the present invention. The effects of the vertical-polarized (strips) are compared with the dual-polarized (patches) cloaks on each polarization excitation. In the bare case, the dominance of V-pol scattering is seen, as expected, while the H-pol is 20 dB (1.7 GHz) to 10 dB (2.7 GHz) lower across the HB band. This low H-pol scattering of the bare LB dipole is on the order of the cloaked dipole residual scattering. The horizontal strip cover considered in FIG. 1 is clearly limited to single V-pol operation since it significantly increases the SCS for H-pol excitation, bringing it up to the level of the bare LB dipole in the upper HB (dots 201 in FIG. 2). As discussed below, vertical gaps are considered to be introduced in the cloak to add capacitive response for the horizontal polarization.

Dual-Polarized Mantle Covers Under Plane Wave Excitation

Figure 3:
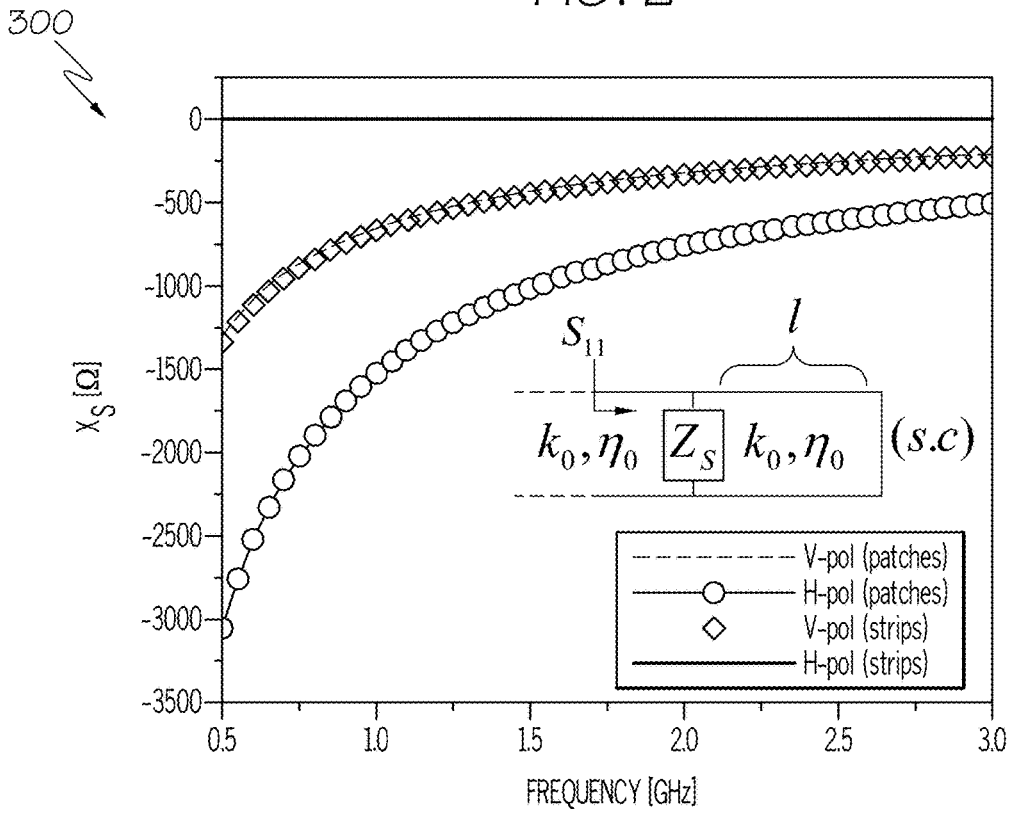
FIG. 3 is a graph illustrating the comparison of the extracted surface impedance for patch and strip metasurfaces at normal incidence in accordance with an embodiment of the present invention.

Rectangular patch covers with slits both in the azimuthal and vertical direction can drastically improve the polarization performance of the considered cloaks. Considering the schematic geometry in FIG. 1, 12 vertical cuts of 1 mm were introduced every 30° in the original horizontal strip cover design, in order to reduce the H-pol scattering increase highlighted in FIG. 2. It is noted that the vertical cuts may be introduced regularly at various degrees, such as between one and four degrees, in the original horizontal strip cover design in an azimuthal direction. FIG. 2 shows the comparison between strip and patch cover, both for V- and H-pol scattering. The additional vertical slits provides a large reactance $Z_S$=−j582Ω at 2.7 GHz for H-waves, which substantially reduces the H-pol scattering, and only marginally increases the scattering for V-pol excitation. In FIG. 3, the surface impedance for each polarization is extracted to compare the different covers. FIG. 3 is a graph 300 illustrating the comparison of the extracted surface impedance for patch and strip metasurfaces at normal incidence in accordance with an embodiment of the present invention. The surface impedance extraction method is simply based on an infinite planar sheet model in free-space, using the finite element method (FEM) with high-density adaptive meshing, as shown by the transmission line model in the inset, where (s.c.) is the electrical short circuit of the covered conductive rod. The effect of the vertical slits is clear in FIG. 3: the surface impedance presents a high reactance across the entire band, which almost completely suppresses the cover presence to H-polarized wavefronts, leaving only the minimal residual scattering from the dipole itself. However the patch array increases polarization coupling and slightly decreases the bandwidth and suppression level. The suppression level for the dual-polarized cloak is about 8 dB at 2.52 GHz with a 5 dB fractional bandwidth of around 18%.

Figure 4:
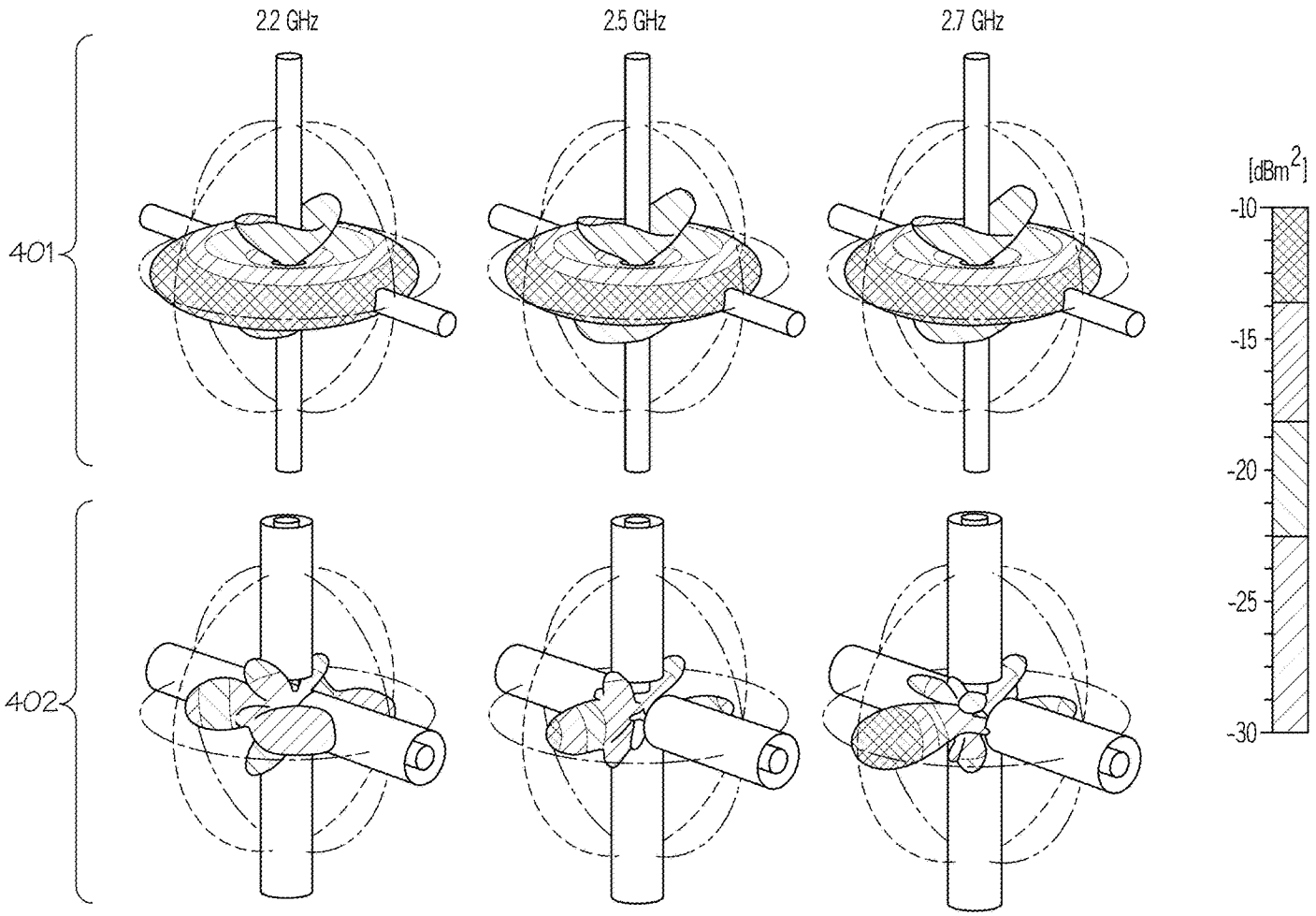
FIG. 4 shows different scattering profiles for a cross-dipole, obtained by combining two orthogonal dipoles as in FIG. 1, under plane-wave illumination in accordance with an embodiment of the present invention.
Figure 5:
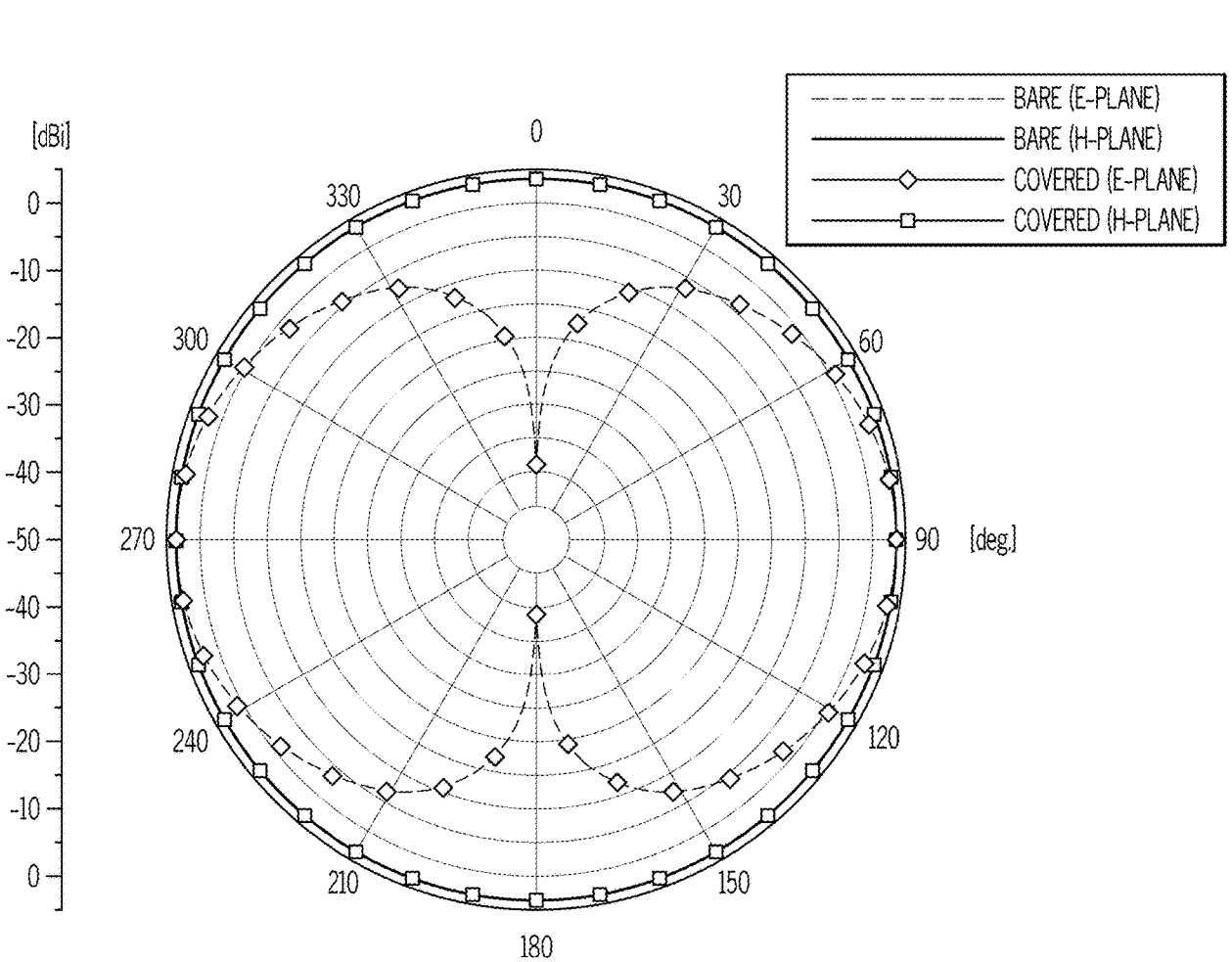
FIG. 5 is a plot illustrating the directivity [dBi] of covered and bare LB dipoles at 800 MHz in accordance with an embodiment of the present invention.

To demonstrate the dual polarized cloaking effect in free-space, FIG. 4 shows different scattering profiles for a cross-dipole, obtained by combining two orthogonal dipoles as in FIG. 1, under plane-wave illumination in accordance with an embodiment of the present invention. Due to the aspect ratio of the cloak, one row of patches at the antenna feed needs to be removed in this combined design. The effect of this removal slightly increases the SCS by 0.6 dB (not shown here for brevity). The top row 401 in FIG. 4 shows the SCS patterns of the bare cross dipole at different target frequencies in the HB, and the bottom row 402 shows the effect of the cloaking cover. Here a vertically polarized wavefront illuminates the structure from the $\hat{x}$ direction ($\phi$=0°,$\theta$ 90°=) with electric field polarized along $\hat{z}$ with amplitude of 1 V/m. Due to symmetry considerations, the crossed-dipoles have a quasi-isotropic response. The patterns highlight the significant scattering reduction at all angles and over a broad range of frequencies. The upper HB frequencies have been chosen since they contribute the most interference to HB radiation. In each case, it is clear that the omnidirectional scattering mode of the dipole is almost completely suppressed, leaving only higher-order scattering contributions. The single-layer cover designs of the present invention are tailored to cancel the dominant scattering order, which achieves a significant performance without complex design schemes. More elaborate anisotropic designs may target more significant scattering suppression, but at the price of significantly reduced bandwidth. Finally, it is shown in FIG. 5, the far-field patterns of the LB antenna with and without cloaks, highlighting how the patterns are nearly identical in accordance with an embodiment of the present invention. In particular, FIG. 5 is a plot 500 illustrating the directivity [dBi] of covered and bare LB dipoles at 800 MHz in accordance with an embodiment of the present invention. This confirms that, due to the high reactance of the cover for both polarizations (FIG. 3), the cloak has little effect on the radiation features of the LB antenna elements.

Experimental Verification

The performance of the cloaked antenna systems has been tested and realized as described below. Furthermore, both near-field distributions and the radiation properties of the cloaked antennas have been analyzed to verify the impact of the designed cloaks in basic communication links.

Near-Field Patterns

Figure 6A:
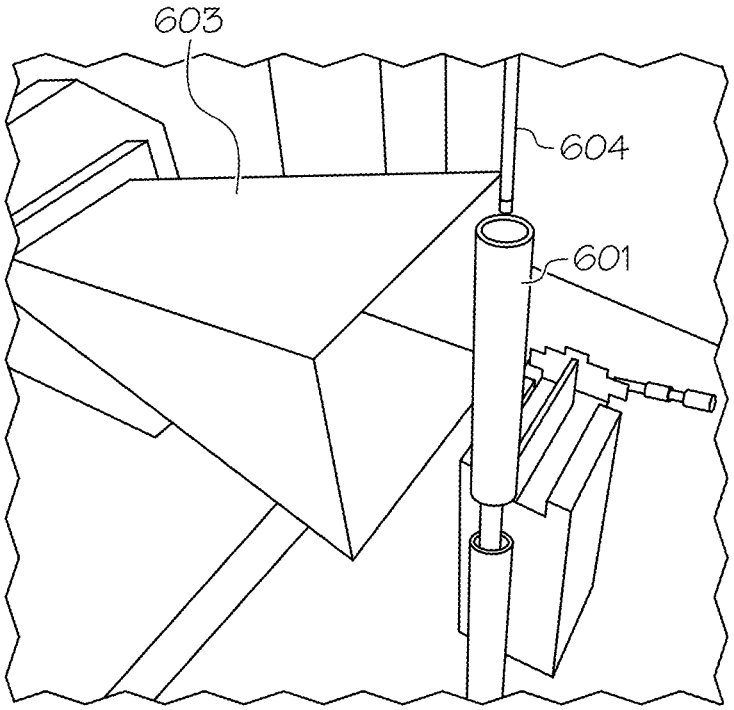
FIGS. 6A-B illustrate the experimental testing setup of bare and covered LB dipoles placed directly in front (extreme near-field) of a standard gain horn in accordance with an embodiment of the present invention.
Figure 6B:
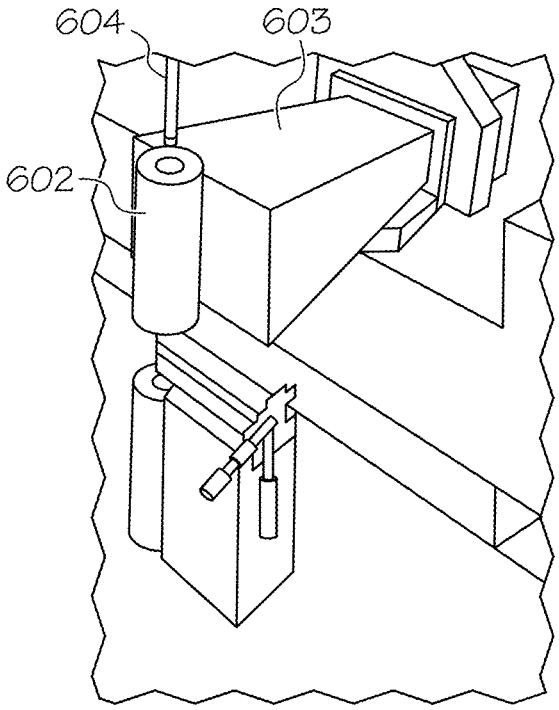

The optimized patch cloak described above, and tailored for a LB dipole antenna, was fabricated using a 1 oz. copper foil cut using a Roland GX-24 vinyl cutter. Delrin spacers were placed on both ends of each dipole arm to provide the required air gap between the mantle cloak and the LB dipole arms. The illuminating microwave source is a Pasternack 10 dBi standard gain horn placed in close proximity to each testing scenario. In FIGS. 6A-6B, the experimental setup is shown, characterized by a distance from the center of each antenna to the horn aperture of only 0.17λ, where λ is the free-space wavelength at 2.7 GHz. FIGS. 6A-6B illustrate the experimental setup of bare and covered LB dipoles 601, 602, respectively, placed directly in front (extreme near-field) of a standard gain horn 603 in accordance with an embodiment of the present invention. The E-field probe 604 is shown directly above each testing setup, illustrating the region where the probe skips to a different plane in each test in order to avoid hitting the antennas under test (AUT). The antennas 601, 602 were essentially placed in such a way that their cover is nearly touching the horn 603 (c.f. FIGS. 6A-6B), to demonstrate that the scattering suppression works independent of the excitation, even in the very near-field of the source.

In each experiment, a Fanuc robotic arm ending with an E-field probe is programmed to perform an accurate raster scan in the plane crossing the center of the LB dipole arm. The raster scans are taken over approximately a 3λ×3λ, scan area with sampling distances Δx=Δ y=0.05λ. The LB dipole is loaded with standard 50Ω terminations in each testing scenario.

Figure 7:
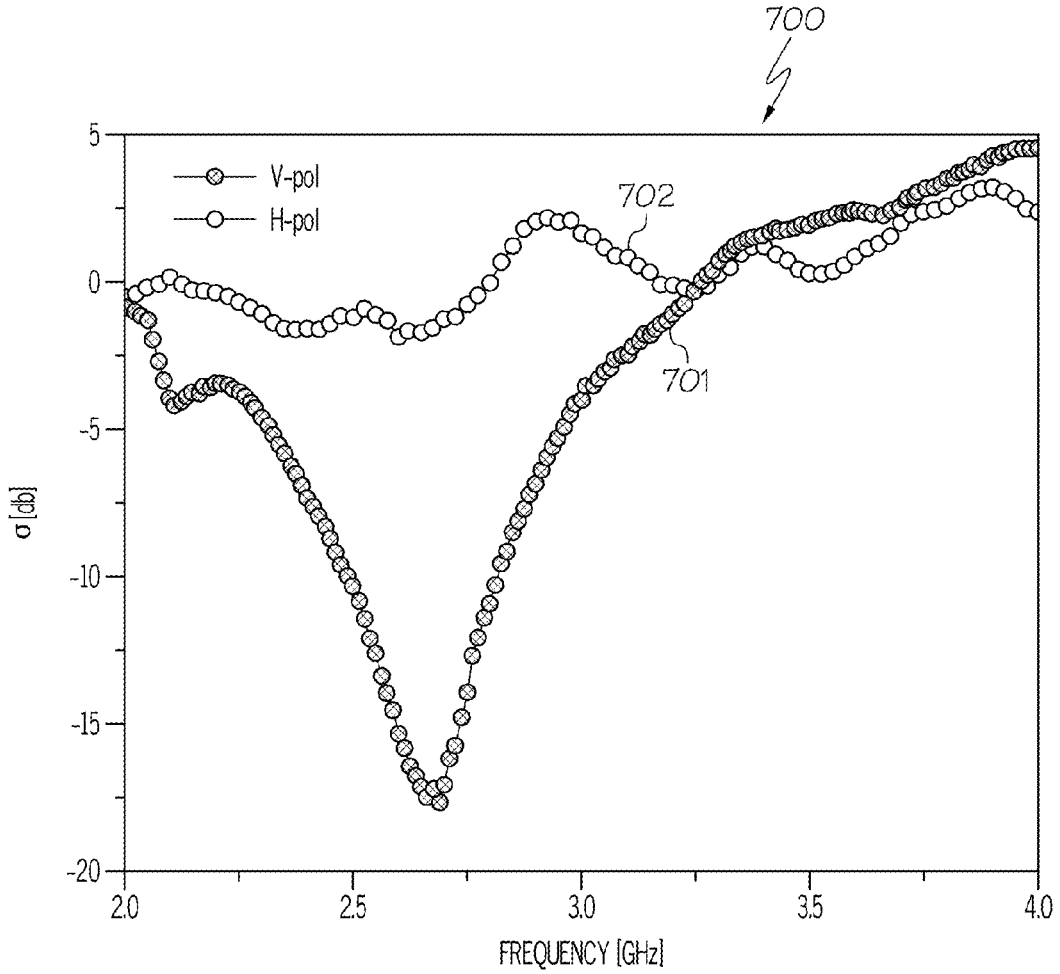
FIG. 7 is a graph illustrating the measured near-field scattering suppression achieved with the patch array cover for both polarizations (vertical polarization and horizontal polarization) in accordance with an embodiment of the present invention.
Figure 8:
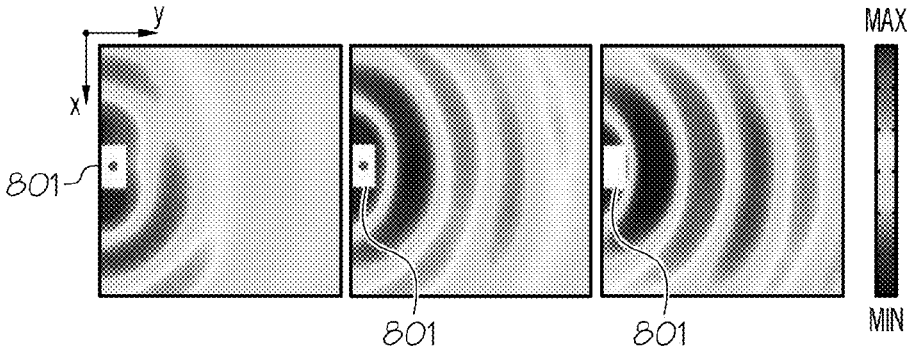
FIGS. 8-11 show the snapshot in time of the near-field scanning images for different frequencies of the extracted electric field in accordance with an embodiment of the present invention.
Figure 9:
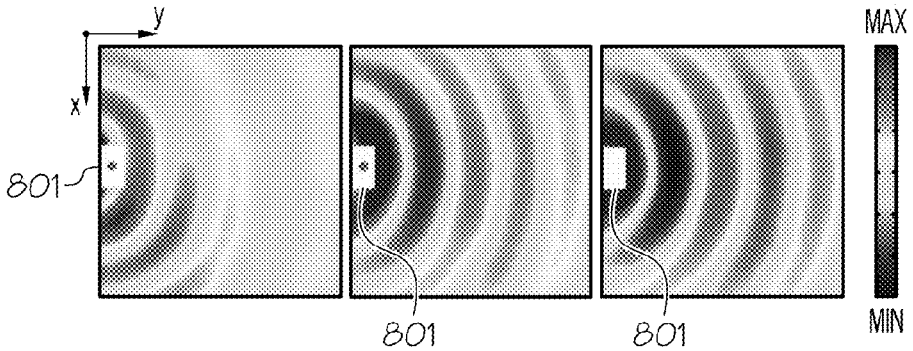
Figure 10:
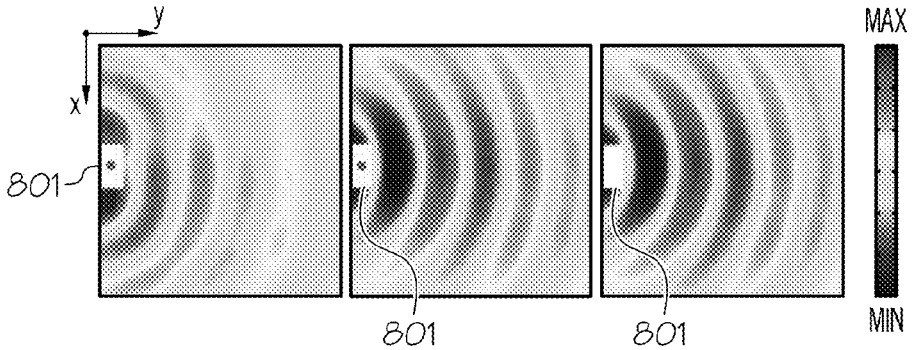
Figure 11:
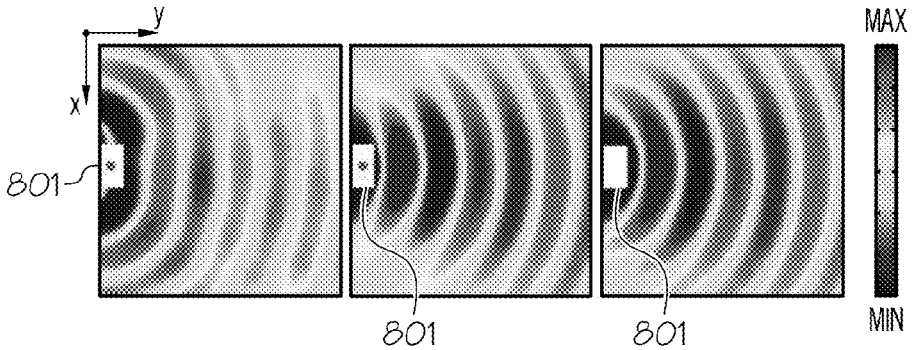

FIG. 7 shows the level of scattering suppression integrated throughout the raster scan. In particular, FIG. 7 is a graph 700 illustrating the measured near-field scattering suppression achieved with the patch array cover for both polarizations (V-pol 701 and H-pol 702) in accordance with an embodiment of the present invention. This figure of merit (FOM) used to quantify the agreement between the cloaked antenna case to the background measurement, without any device in front of the horn, is $$\sigma = \int_{scan} \frac{|E_{cov} - E_0|^2}{|E_{bare} - E_0|^2}\, dS. \tag{2}$$

In EQ (2), $E_{cov}$, $E_{bare}$, and $E_0$ are the time-harmonic fields measured pixel-by-pixel in the raster scan around the cover, bare, and free-space fields, respectively. This quantity provides a raw descriptive metric of how well the cover can reduce the overall near-field scattering, reflections and field distortion, compared to the bare antenna. It is noted that this FOM is not the scattering width of the object, but it is directly related to it in the sense that a small far-field scattering necessarily corresponds to small field perturbations around the object under test. In FIG. 7, a strong reduction in near-field scattering obtained by the patch array is seen, with a 10 dB fractional bandwidth of 12%, and a maximum suppression of nearly 18 dB at 2.69 GHz. Even though direct comparison to the SCS of the simulated patch array is misleading for the reasons outlined above, the suppression lineshape and level show excellent agreement. As expected, the H-pol scattering suppression is more limited (hollow dots 702 in FIG. 7), due to the fact that the original scattering from the bare dipole is very small. The fact that σ stays around 0 dB over the frequency range of interest ensures that the cloak does not add significant scattering in the H-pol excitation, while the vertical strip cloak (not shown here), would introduce significant additional scattering compared to the bare case.

FIGS. 8-11 show the snapshot in time of the near-field scanning images for different frequencies (2.3 GHz, 2.4 GHz, 2.69 GHz and 3.0 GHz, respectively) of the extracted electric field in accordance with an embodiment of the present invention, providing more insights into the performance of the patch array cloak in the presence of very near-field and non-uniform excitations. In each Figure, box 801 refers to the region that the scanner avoided, since it corresponds to the location of the antenna. In each case, the bare AUT strongly distorts the total electric field radiated by the horn throughout the raster scan area. This disturbance allows some radiation from the microwave source to propagate, but it is far less than the one observed in free-space. On the other hand, the patch array cloak cancels a significant portion of the scattering due to the LB antenna, and allows the horn to radiate as in free-space in all considered frequencies. The frequency band between 2.5-2.8 GHz has a suppression level better than 10 dB (FIG. 7), and this is consistent with the near-field restoration in FIGS. 8-10.

Broadband Gain Restoration of a Log-Periodic Antenna Link

Figure 12:
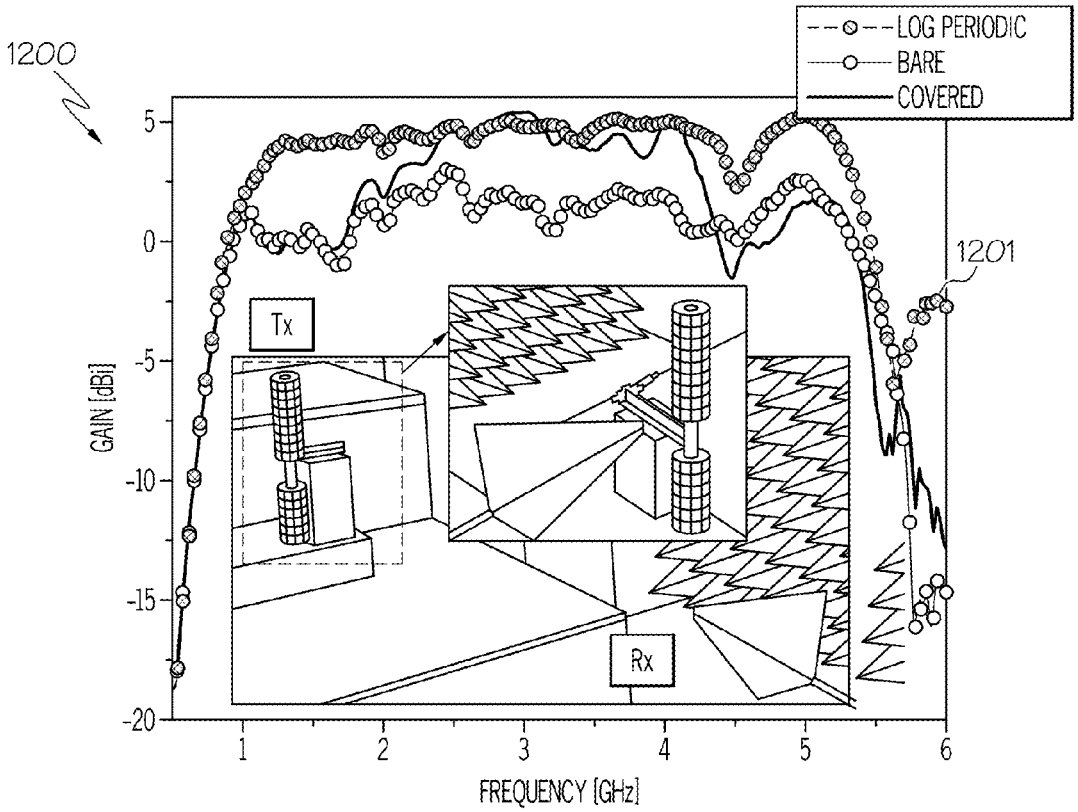
FIG. 12 is a graph illustrating the far-field gain measurement in accordance with an embodiment of the present invention.

As a second experimental verification, the gain between two off-the-self PCB log-periodic antennas are compared in the presence of the bare and covered LB antennas placed directly within their line-of-sight path. This experiment demonstrates the gain restoration in a link connection by removing the shadow and scattering created by the bare LB antenna. First, two log-periodic antennas separated by R=1 m (≈9λ) are considered. Assuming the two antennas to be identical, the gain (line 1201) was calculated using the usual Friis transmission equation as shown in FIG. 12 which is a graph 1200 illustrating the far-field gain measurement in accordance with an embodiment of the present invention:

$$|S_{21}|^2 = \left(\frac{\lambda_0}{4\pi R}\right)^2 G_{Tx} G_{Rx}. \tag{3}$$

Here in EQ (3), $S_{21}$ is the measured transmission between the two antennas, $\lambda_0$ is the wavelength and $G_{Tx}=G_{Rx}$ the gain of the transmitting and receiving antennas respectively. Next, the gain was measured using EQ (3) when a bare LB antenna was placed at 0.3λ from the transmitting log-periodic antenna, as shown in the inset of FIG. 12, using the previously measured receiver gain $G_{Rx}$. The cloak was then placed over the blocking LB antenna, and the transmitting gain was again calculated using EQ (3) with the same receiver gain $G_{Rx}$. Across a broad frequency range of 2-4 GHz, strong improvement is seen when the cloak is applied compared to the blocking LB antenna. Specifically at 2.69 GHz, an improvement of 3.65 dB was measured, which matches that of the log-log measurement of 4.94 dBi. This result shows that the cloak is effective to different forms of excitation, and allows realizing antennas capable of radiating in a low-frequency band, yet remaining essentially radio-transparent in the desired high-frequency band.

Figure 13:
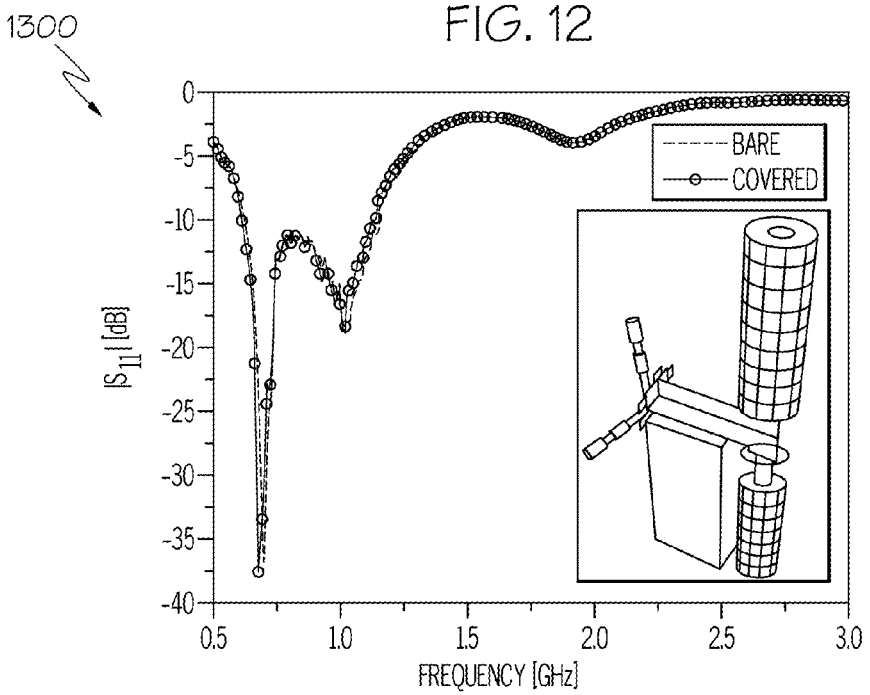
FIG. 13 is a graph illustrating the input matching comparison between the covered and bare LB antenna in accordance with an embodiment of the present invention.

Referring to FIG. 13, FIG. 13 is a graph 1300 illustrating the input matching comparison between the covered and bare LB antenna in accordance with an embodiment of the present invention. In particular, FIG. 13 illustrates the comparison between the measured reflection coefficient with and without cloak across the LB frequency range. It is evident that the matching properties are not affected by the presence of the cloak, while, given the cloak isotropy, also the radiation patterns are not influenced. Essentially the cloak does not influence the radiation properties in the LB due to the high surface reactance values of the cover.

As a result, the principles of the present invention provide a simple, inexpensive and light-weight cover applicable on a conventional dipole antenna to strongly reduce the scattering of dual-polarized sources over a wide bandwidth, while not affecting its radiation performance in the low band of interest. The proposed cover, formed by a dense array of metallic patches, may be used with dual-polarized sources in very close proximity. While the cover thickness allows broadening the bandwidth of scattering suppression, it also affects the performance for cross-polarized fields, requiring special attention to both incident polarizations. By applying the patch array to a LB dipole antenna, it has been shown that the cloaked antenna radiation performance is almost unaffected compared to the bare case. The results have been validated with two different illuminations, a microwave horn in the very near field and a log-periodic antenna. More broadly, these concepts open a new venue to design compact antenna and sensor systems, where inter-element antenna interference may be strongly reduced without sacrificing performance in bandwidth, directivity or matching.

The metasurface designs for incident orthogonal polarizations, which is important to being able to produce cloaks working for arbitrary objects and polarizations, will now be discussed.

Metasurface Design for all Polarizations

Analytical Models

Figure 14:
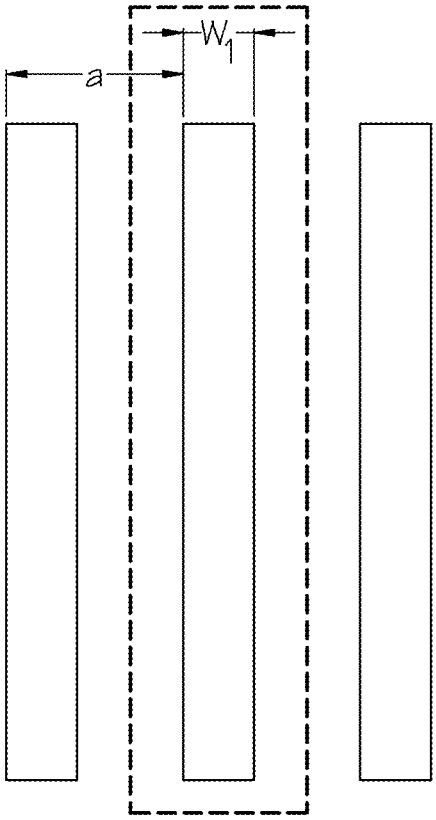
FIG. 14 illustrates an anisotropic metasurface with a unit-cell of an array of metallic strips in accordance with an embodiment of the present invention.

Referring to FIG. 14, FIG. 14 illustrates an anisotropic metasurface with a unit-cell (inside the dashed line) of an array of metallic strips in accordance with an embodiment of the present invention. The structure consists of an array of thin metallic strips printed on a dielectric substrate with relative permittivity $\in_r$. The equivalent surface reactance of the infinite periodic structure has been studied by various authors employing different approaches.

In the general case, without any additional assumption on the strip periodicity, beyond being electrically small, the surface impedance exhibited by the structure when illuminated by a TM (i.e., electric field parallel to the strips) normally-incident plane wave can be expressed by the following closed-form formula:

$$Z_s^{grid,TM} = jX_s^{grid,TM}\, j\frac{\eta_{eff}}{2}\alpha = j\sqrt{\frac{\mu_0}{\varepsilon_0\varepsilon_{eff}}}\,\frac{\alpha}{2}, \tag{4}$$

where $\eta_{eff}$ is the effective wave impedance and $\alpha$ is the so-called grid parameter. It is noted that the effective permittivity can be expressed as $\in_{eff}=(\in_r+1)/2$, assuming that the background medium of the impinging wave is a vacuum. For electrically dense arrays ($k_{eff}a<<2\pi$), the grid parameter has the simple expression $$\alpha = \frac{k_{eff}\,a}{\pi}\ln\left[\csc\left(\frac{\pi w_1}{2a}\right)\right]. \tag{5}$$

In order to study the response of the structure of FIG. 14 to a TE (i.e., electric field perpendicular to strips) normally-incident plane wave, one can apply the formulas of the complementary structure, obtained using Babinet's principle in its modified form to take into account the presence of a dielectric discontinuity at the interface. Therefore, the surface impedance of the grid for TE incidence is $$Z_s^{grid,TE} = jX_s^{grid,TE}\frac{2}{(\varepsilon_r+1)} = \frac{\eta_0^2}{4Z_s^{grid,TM}}. \tag{6}$$

It is noted that for TE incidence the term $w_1$ in the expression of $Z_s^{grid,TM}$ in EQ (6) is now replaced by $a-w_1$.

To summarize, if the incident electric field is parallel to the strips, the impedance exhibited by the metasurface is inductive, while for orthogonal excitation the response of the structure is purely capacitive.

Figure 15:
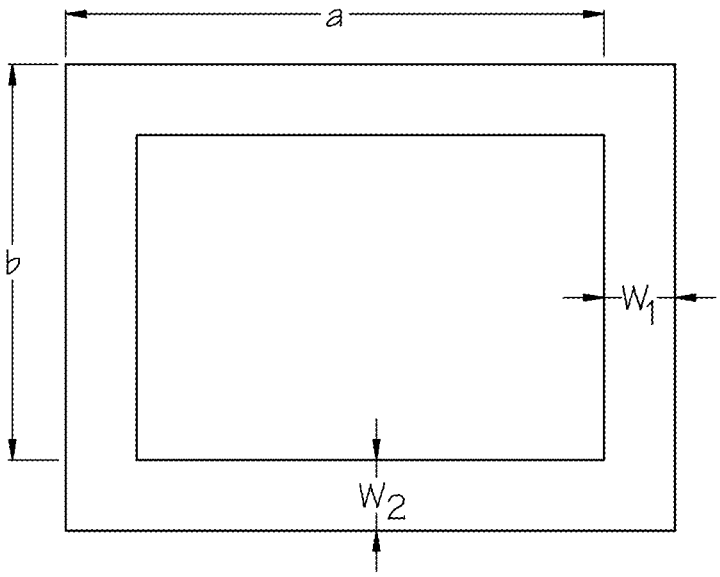
FIG. 15 illustrates a unit-cell of a rectangular metasurface, where $w_1$ and $w_2$ are the widths of each parallel segment of the metasurface lattice and a and b are the lengths of each parallel segment of the metasurface lattice in accordance with an embodiment of the present invention.

Referring now to FIG. 15, FIG. 15 illustrates a unit-cell of a rectangular metasurface, where $w_1$ and $w_2$ are the widths of each parallel segment of the metasurface lattice and a and b are the lengths of each parallel segment of the metasurface lattice in accordance with an embodiment of the present invention. The widths of the vertical and horizontal strips, as well as their lengths, can vary independently. Thanks to the structure anisotropy, it is possible to obtain different surface reactance values for orthogonal polarizations. As shown in the following, this feature opens the possibility to design mantle cloaks effective for all polarizations of the incident plane wave, and for objects made of anisotropic materials and/or with an anisotropic shape.

The transition from the structure of FIG. 14 to a rectangular unit-cell metasurface introduces a resonant response, since a rectangular unit-cell is characterized by an inductance, associated to the vertical or the horizontal strips (depending on the incidence polarization), and a capacitance, associated to the orthogonal strips. However, for subwavelength dimensions, the self-resonant frequency (SRF) will be much higher than the cloaking band. Such a structure can be therefore analytically studied using the grid model expressed by EQ (5) and EQ (6). In particular, it is easy to verify that, if one applies an external plane wave with an electric field parallel to the vertical strips (TM incidence), the overall surface impedance is given by the parallel combination of the effective inductance associated with the parallel strips and the effective capacitance of the orthogonal ones. Performing the calculation, one obtains:

$$Z_s^{rect,TM} = \frac{Z_s^{grid,TM}Z_s^{grid,TE}}{Z_s^{grid,TM}+Z_s^{grid,TE}} = jX_s^{rect,TM} = \frac{-j\eta_0(ac_0f)\ln\left[\csc^2\left(\frac{\pi w_1}{2a}\right)\right]}{abf(1+\varepsilon_r)\ln\left[\csc^2\left(\frac{\pi w_1}{2a}\right)\right]\ln\left[\sec^2\left(\frac{\pi w_2}{2b}\right)\right]-2c_0^2}, \tag{7}$$

where $c_0$ is the speed of light in vacuum and f is the frequency. Similarly, if the external plane wave has an electric field parallel to the horizontal strips (TE incidence), the surface impedance $Z_s^{rect,TE}$ can be simply obtained by replacing a with b and $w_1$ with $w_2$.

For the complementary structure, consisting of metallic patches printed on a dielectric substrate (also referred to as mesh metasurface), the expressions are the dual of those obtained for the structure in FIG. 14: $Z_s^{meshes,TE}=Z_s^{grid,TM}$ and $Z_s^{meshes,TM}=Z_s^{grid,TE}$.

Figure 16:
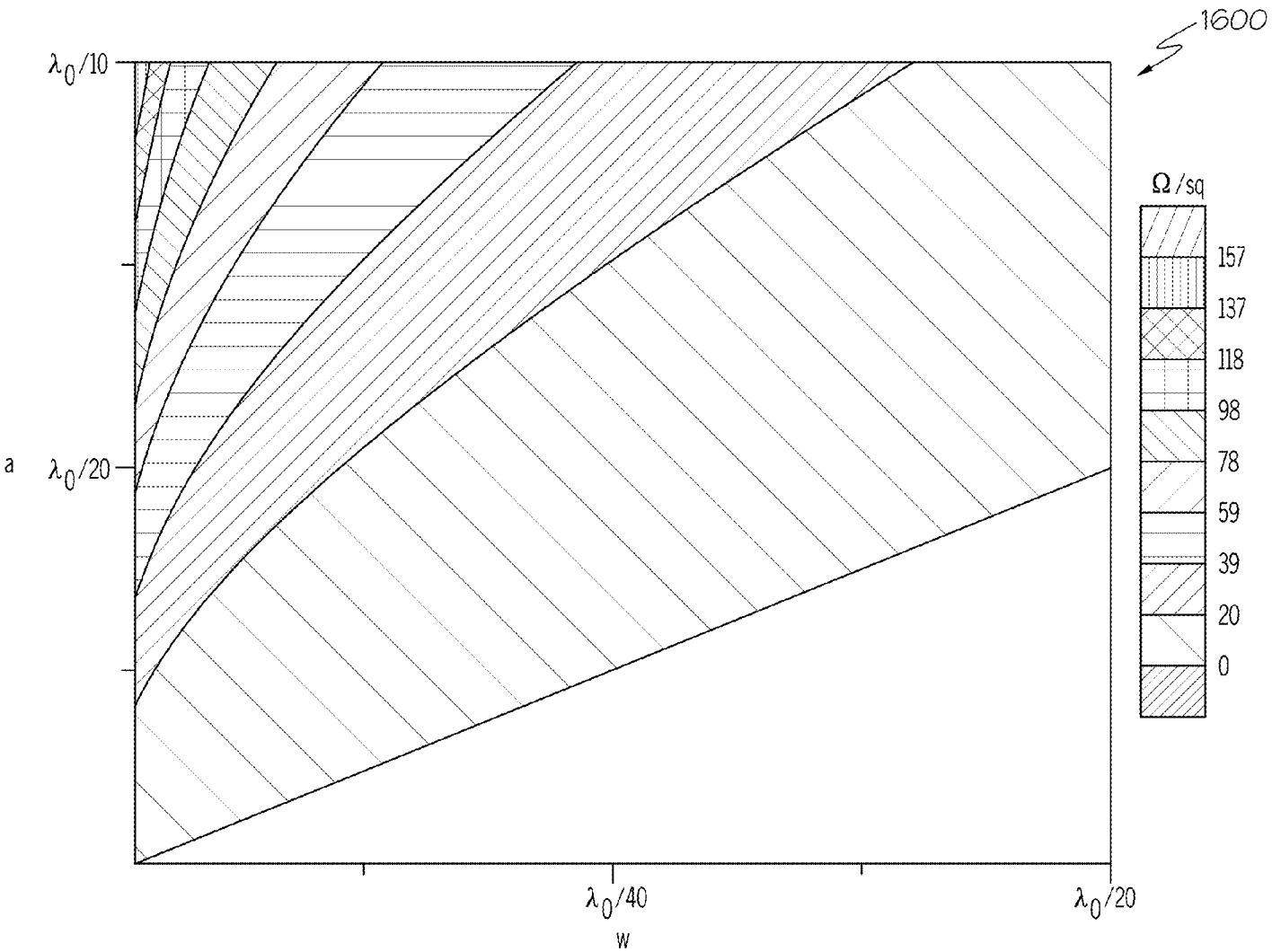
FIG. 16 is a contour plot that illustrates the surface reactance for a metasurface characterized by a rectangular unit-cell for different geometric parameters in accordance with an embodiment of the present invention.

Varying the values of a, b, $w_1$ and $w_2$, the metasurface exhibits different values of effective reactance for the two orthogonal polarizations. Referring to FIG. 16, FIG. 16 is a contour plot 1600 that illustrates the surface reactance for a metasurface characterized by a rectangular unit-cell (FIG. 15) for different geometric parameters in accordance with an embodiment of the present invention. In contour plot 1600, a=b, $w_1=w_2=w$, and the geometrical parameters are varied in the range $\lambda_0/1000\le a\le\lambda_0/10$ and $\lambda_0/1000\le w\le\lambda_0/20$ with $a>w_1$. It is evident that the effective surface reactance is always positive (i.e., inductive) independently from the incidence polarization, due to the large value of shunt capacitance in EQ (7). For this reason, as discussed below, this type of metasurface is useful to design cloaks for objects requiring positive values of surface reactance for both polarizations. Another important observation arising from EQ (7) is that the values of $Z_s^{rect,TM}$ and $Z_s^{rect,TE}$ are only slightly affected by the relative permittivity of the dielectric substrate $\in_r$. In fact, as it is evident from equations EQ (4)-(6), the relative permittivity plays a role only for the capacitive part of the surface impedance, whereas, it does not contribute to the inductance of the strips parallel to the impinging electric field. Since the strip capacitance assumes a very large value and can be neglected in the parallel combination EQ (7), the contribution of a non-extreme permittivity to the overall impedance EQ (7) is generally negligible.

Figure 17A:
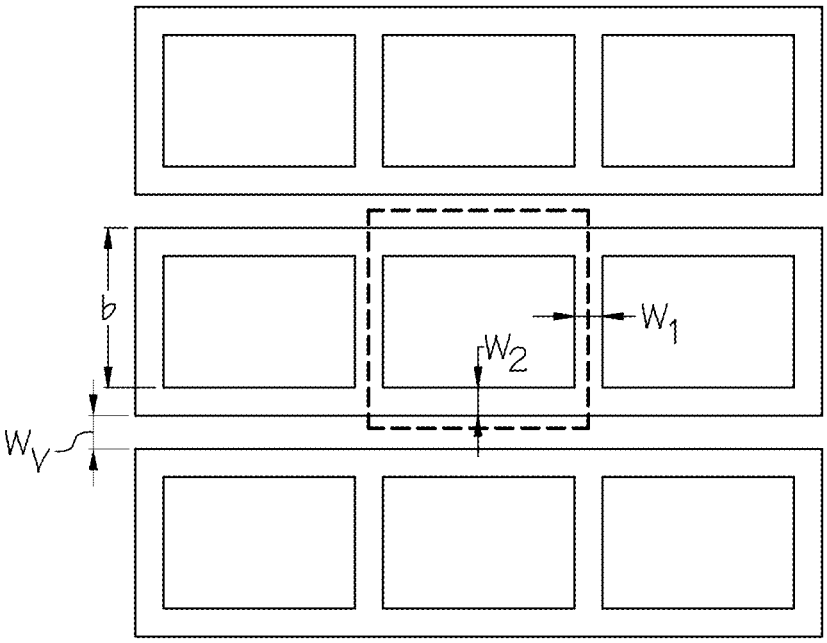
FIGS. 17A and 17B illustrate the metasurface characterized by a rectangular unit-cell with (a) horizontal and (b) vertical slits able to exhibit a negative value of surface reactance for transverse magnetic (TM) and transverse electric (TE) polarization, respectively, in accordance with an embodiment of the present invention.
Figure 17B:
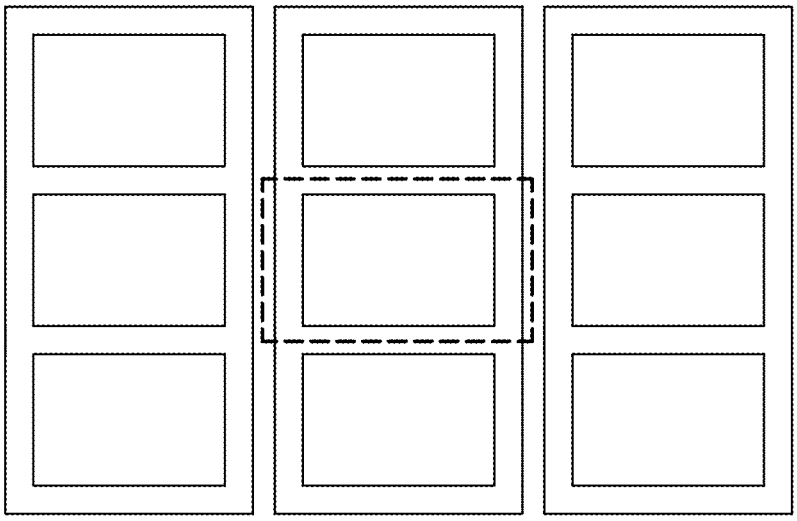

In some practical cases, the surface reactance exhibits different signs for TE and TM polarizations. Metasurface geometries able to synthesize different combinations of surface reactance signs for the two orthogonal polarizations are, therefore, necessary. To achieve this goal, the easiest choice is to add small modifications to the rectangular unit-cell geometry, as shown in FIGS. 17A and 17B. FIGS. 17A and 17B illustrate the metasurface characterized by a rectangular unit-cell with (a) horizontal and (b) vertical slits able to exhibit a negative value of surface reactance for TM and TE polarization, respectively, in accordance with an embodiment of the present invention. By introducing horizontal and/or vertical slits in the rectangular unit-cell, one can provide additional capacitance for TM and/or TE polarization (depending on necessity), without changing the sign for the other polarization. Polarization coupling will be present, but only slightly de-tunes the operating frequency for each polarization, especially at oblique angles of incidence. These small modifications keep the overall design simple and provide additional degrees of freedom for the effective design of metasurface-based mantle cloaks. It is worth noting that, as can be inferred analyzing the analytical models of the Jerusalem crosses and of the cross dipoles, there are also other metasurface geometries that may exhibit different signs of their intrinsic surface reactance for different incidence polarizations. However, their practical implementation for curved objects is not so easy, and, moreover, their cloaking performances have proven to be lower compared to the ones of grid and patch metasurfaces.

It is possible to develop a proper circuital representation of the horizontal and/or vertical cut metasurfaces in the limit of small slits. The steps to derive the circuit model of the structure depicted in FIG. 17A are now described. The generalization of this model to the structure of FIG. 17B, as well as to a metasurface with both horizontal and vertical slits is straightforward, and, thus, here omitted. As a first observation, we note that, for TM incidence, the vertical slits introduce an additional capacitance C connected in series to the inductance L of the vertical strips. This LC series circuit (whose impedance is denoted as $Z_s^{V,TM}$) is then connected in parallel to the capacitance of the horizontal strips (with impedance $Z_s^{H,TM}$). Therefore, the overall surface impedance $Z_s^{H\text{-}slits,TM}$ of the rectangular horizontal-cut metasurface can be expressed as:

$$Z_s^{H-slits,TM} = \frac{Z_s^{V,TM} Z_s^{H,TM}}{Z_s^{V,TM} + Z_s^{H,TM}}. \tag{8}$$

Since $Z_s^{V,TM}$ is the series between an inductance and a capacitance, its expression is equal to:

$$Z_s^{V,TM} = Z_L^{V,TM} + Z_C^{V,TM}, \tag{9}$$

being $Z_L^{V,TM}$ and $Z_C^{V,TM}$ the impedance associated to L and C, respectively. The expression of $Z_L^{V,TM}$ can be easily obtained applying formulas EQ (4)-(5). After some trivial calculations and setting $\in_r=1$, it is possible to obtain:

$$Z_L^{V,TM} = jX_L^{V,TM} = j\frac{ak_0\eta_0 \ln\left[\csc\left(\frac{\pi w_1}{2a}\right)\right]}{2\pi}, \tag{10}$$

$$Z_C^{V,TM} = -JX_L^{V,TM} = -j\frac{2\pi\eta_0}{4(b+w_2)k_0 \ln\left[\csc\left(\frac{\pi w_V}{2(b+w_V+w_2)}\right)\right]}.$$

It is noted that the expression of $Z_C^{V,TM}$ can be derived from EQ (6) considering a capacitive strip effect given by an equivalent strip with width $w_V$ and separation distance equal to $b+w_V+w_2$ and multiplying the result by a geometrical factor due to the fact that the conductor is not continuous.

The only other unknown quantity in EQ (8) is $Z_s^{H,TM}$. Since it represents the capacitive effect of the horizontal strips perpendicular to the incidence electric field, its expression can be easily derived directly applying EQ (6). Therefore, all the quantities in EQ (8) have been defined and it is possible to numerically compute the value of $Z_s^{H\text{-}slits,TM}$ through a numerical code.

It is further noted that the introduction of the vertical slits also produces a variation in the TE surface impedance of the structure. The TE surface impedance is still expressed by the dual of EQ (7), but, in the horizontal-cut rectangular unit-cell metasurface, equivalent strips are considered with width equal to $2w_2+w_V$ and separation distance equal to $b+2w_2+w_V$. As already mentioned and as it is clear from the electromagnetic analysis developed so far, these variations do not change the sign of the TE surface impedance that still remains inductive, but they produce a lowering of $Z_s^{H\text{-}slits,TE}$ compared to $Z_s^{rect,TE}$ that needs to be taken into account in the metasurface design.

Differently from the case of the rectangular unit-cell metasurface, the vertical and/or horizontal-cut metasurfaces are affected by the presence of a dielectric substrate because the capacitive effect $Z_C^{V,TM}$ depends on the value of $\in_r$. Since a goal of the present invention is to use such metasurfaces to cloak a finite-size object and the metasurfaces are placed at a certain distance from the object to hide, it is not very useful, even though straightforward, to generalize the expression of $Z_C^{V,TM}$ in the case of an infinite-dielectric backed metasurface. Rather than using empirical models, it is certainly convenient to take into account the potential residual coupling of these metasurfaces with the object to hide exploiting a numerical procedure.

As discussed below, a numerical procedure, based on full-wave simulations, to retrieve the exact value of the surface impedance of a given metasurface is derived. Such a procedure will be proven useful to refine the initial design based on these analytical models.

Refinement Design Procedure

Refinement Design Procedure

As previously discussed, different metasurface geometries that represent a complete set to design cloaking covers for both incident polarizations was explored. In fact, the considered metasurface geometries allow synthesizing the desired signs and range of values of surface reactance for TE and TM incidence to achieve scattering reduction for a rather wide variety of object shapes. It should be mentioned that these formulas are derived for planar metasurfaces, and it is not in principle expected that they may be directly extended, as they are, for curved metasurfaces wrapping an arbitrary object. Assuming, however, that the period is significantly smaller than the curvature, one may expect that they remain locally valid also for curved geometries. Indeed, the accuracy of some of these analytical formulas has been verified for cylindrical cloaks working with a single incident polarization. Additionally, finite length (3D) conducting rods show different scattering characteristics as opposed to infinite rods (2D), which further affect the effectiveness of realistic covers.

For covers working in dual polarization, however, a higher accuracy on the value of surface reactance is typically required for a good functionality. Moreover, the coupling between the designed metasurface and the object to hide may introduce an asymmetric variation in the intrinsic surface impedance of the structure for TM and TE polarization, resulting in a variation of the actual cloaking frequencies compared to the design ones. For these reasons, it is useful to introduce a numerical algorithm that can be applied to the metasurface design in order to improve its accuracy and fine tune the layout of the optimal metasurface design. It is noted that an analogous optimization of the analytical design may be also directly performed on the final structure made of the object to hide with the designed metasurface applied around. In that case, however, the numerical optimization would require significant major numerical efforts compared to the procedure described below that it is easy and quick.

Figure 18:
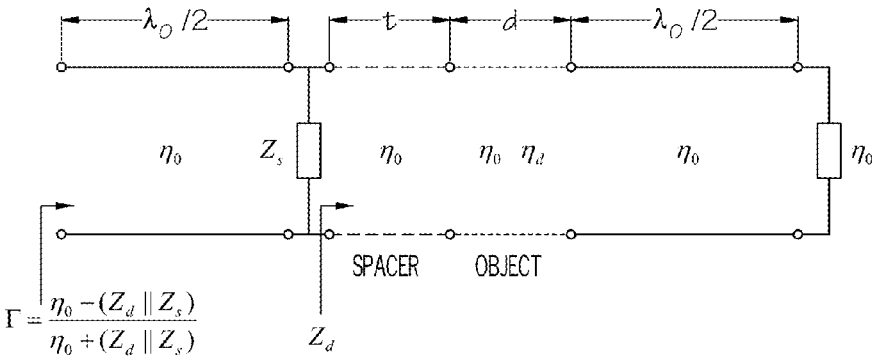
FIG. 18 illustrates the transmission line model used to retrieve the required value of shunt surface impedance $Z_s$ in accordance with an embodiment of the present invention.

In order to retrieve the value of surface impedance of a generic metasurface, the transmission-line model shown in FIG. 18 is considered. FIG. 18 illustrates the transmission line model used to retrieve the required value of shunt surface impedance $Z_s$ in accordance with an embodiment of the present invention. In this simple model, the metasurface is represented by a lumped element $Z_s$, while the spacing between the metasurface and object is represented by a transmission-line segment with length t and characteristic impedance $\eta_0$. The object to hide, placed beyond the metasurface, is modeled as a transmission line segment with thickness d and characteristic impedance $\eta_d\eta_0$. Finally, two half-wavelength transmission line segments are included before and after the surface to take into account the wave propagation in the simulated domain, neglecting the contribution of evanescent fields near the interface. The equivalent transmission-line model of FIG. 18 is able to take into account all the possible perturbations to the ideal model derived above as the finite-accuracy of the analytical models or the coupling between the object and the metasurface.

The reflection coefficient $\Gamma_n$ (with n=TM,TE) at the input port is given in terms of t, d, $\eta_d$ and $Z_s$ by being $$\Gamma_n = \frac{\eta_0 - (Z_s^n \,||\, Z_d)}{\eta_0 + (Z_s^n \,||\, Z_d)},\ n = TM,\ TE \tag{11}$$

$$Z_d = \frac{\sqrt{\varepsilon_r}\,\eta_0\left(\tan\left[\frac{2\pi t}{\lambda_0}\right] - j\right) + \eta_0\left(1 + j\varepsilon_d \tan\left[\frac{2\pi t}{\lambda_0}\right]\right)\tan\left[\frac{2\pi d\sqrt{\varepsilon_d}}{\lambda_0}\right]}{\sqrt{\varepsilon_d}\left(\tan\left[\frac{2\pi t}{\lambda_0}\right] - j\right) + \left(\varepsilon_d + j\tan\left[\frac{2\pi t}{\lambda_0}\right]\right)\tan\left[\frac{2\pi d\sqrt{\varepsilon_d}}{\lambda_0}\right]}. \tag{12}$$

Formula (11) can be inverted with respect to $Z_s$, to obtain $$Z_s^n = \frac{Z_d\eta_0(1+\Gamma_n)}{Z_d(1-\Gamma_n) - \eta_0(1+\Gamma_n)},\ n = TM,\ TE. \tag{13}$$

Once $\Gamma_n$ is numerically computed for a given metasurface and for both incident polarizations using a full-wave simulator, the model (13) allows retrieving, frequency by frequency, the corresponding value of $Z_s$. For simulations of the present invention, the frequency solver of CST Microwave Studio was adopted, that is a full-wave simulator based on the Finite Integration Technique.

This model can also be adopted to the case of metallic objects. This is an interesting case because, especially for electrically small separation distance t, the presence of a metal backing is able to introduce a significant perturbation in the surface impedance values of the metasurfaces. In terms of the transmission-line model, it is sufficient to replace the second transmission line segment of FIG. 18 with a short circuit. The value of $Z_d$ becomes:

$$Z_d = j\eta_0 \tan\left[\frac{4\pi t}{\lambda_0}\right]. \tag{14}$$

Figure 19:
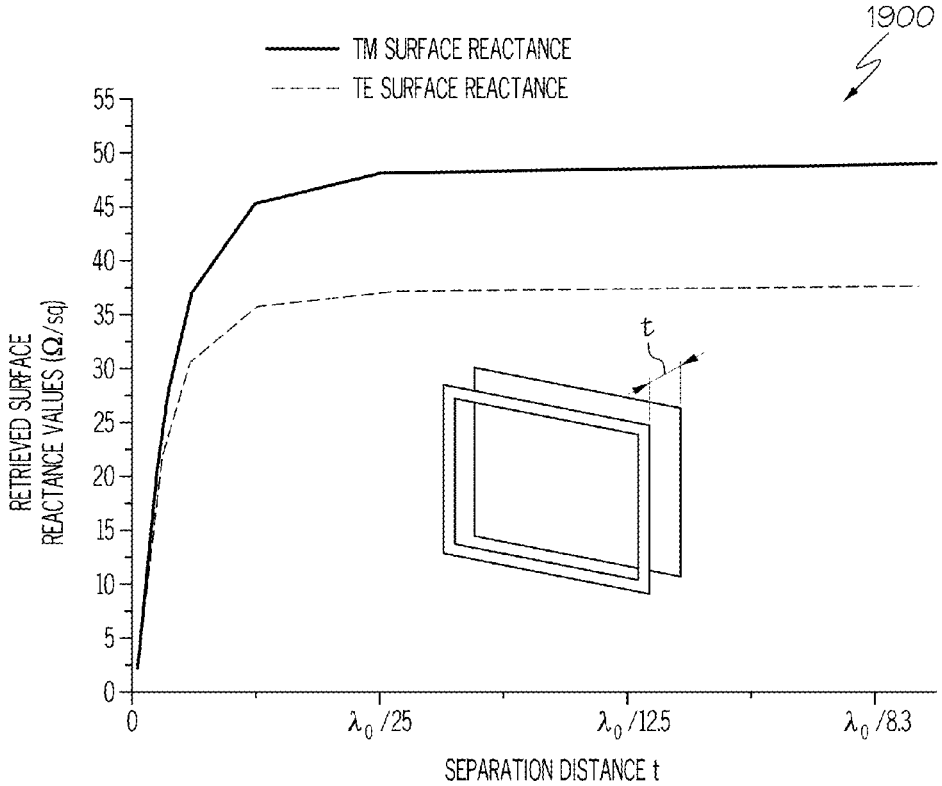
FIG. 19 is a graph that shows the retrieved surface impedance value of a metal-backed rectangular unit-cell metasurface for different separation distances t in accordance with an embodiment of the present invention.

As an example that further highlights the utility of the proposed numerical refinement procedure is shown in FIG. 19. FIG. 19 is a graph 1900 that shows the retrieved surface impedance value of a metal-backed rectangular unit-cell metasurface for different separation distances t in accordance with an embodiment of the present invention. In particular, FIG. 19 shows the retrieved analytical surface impedance values for both TM and TE polarization for a metal-backed rectangular unit-cell metasurface with $a=\lambda_0/12.5$, $b=\lambda_0/16.6$, $w_1=\lambda_0/111$ and $w_2=\lambda_0/166$ (shown in the inset of the picture). For such a structure, the theoretical surface impedance values predicted using EQ (7) and its dual are $Z_s^{TM}=52.4\Omega$ and $Z_s^{TE}=42\Omega$, respectively.

The surface impedance values have been retrieved for different separation distances between the metal plate and the metasurface. As is evident, the coupling is responsible for a perturbation in the actual surface impedance values, especially for very small separation distances. Once such a distance is fixed, depending on the cloaking requirements, it is possible to properly modify the analytical design by means of the quick and straightforward proposed numerical optimization on the metasurface unit-cell.

The design formulas discussed above can be applied to 1D, 2D and 3D objects that require an anisotropic metasurface in order to obtain scattering reduction for both polarizations at the same frequencies. The design procedure of the present invention may be applied to all layers constituting the cloak, providing a powerful and general tool for the design of mantle cloaks.

Furthermore, it is noted that the cover performance is generally worse for TE than TM polarization in terms of SCS gain. This can be attributed to the fact that TE scattering is usually the combination of several scattering orders with similar amplitudes, differently from what happens in the TM case for which it is possible to recognize a dominant contribution from the lower scattering harmonic. With a single-layer cover, one can typically suppress one or two scattering orders, and, therefore, the SCS gain in the TE case is inevitably lower compared to the TM case. It is further noted that the achieved results are comparable with the theoretical predictions obtained using a rigorous formulation of the scattering problem where available. This means that the proposed procedure allows one to design devices able to reach the best theoretical performances for a single dual-polarization cloak. Also in this case, multilayered mantle cloaks may help achieving further total SCS reductions since they allow the suppression of multiple scattering orders concurring to the overall TE scattering.

The mantle cloaking technique discussed above can be extended to bi-layer or multi-layer cloaks in order to increase the bandwidth of operation and add more flexibility in band selection as discussed below.

Bi-Layered or Multi-Layered Mantle Cloaks for Increased Bandwidth

Scattering Theory for Infinitely Long Cylinders

While the following discusses the scattering theory in connection with cylinders, the principles of the present invention may be applied to any arbitrary shape with any arbitrary layers. A person of ordinary skill in the art would be capable of applying the principles of the present invention to such implementations. Further, embodiments applying the principles of the present invention to such implementations would fall within the scope of the present invention.

Figure 20:
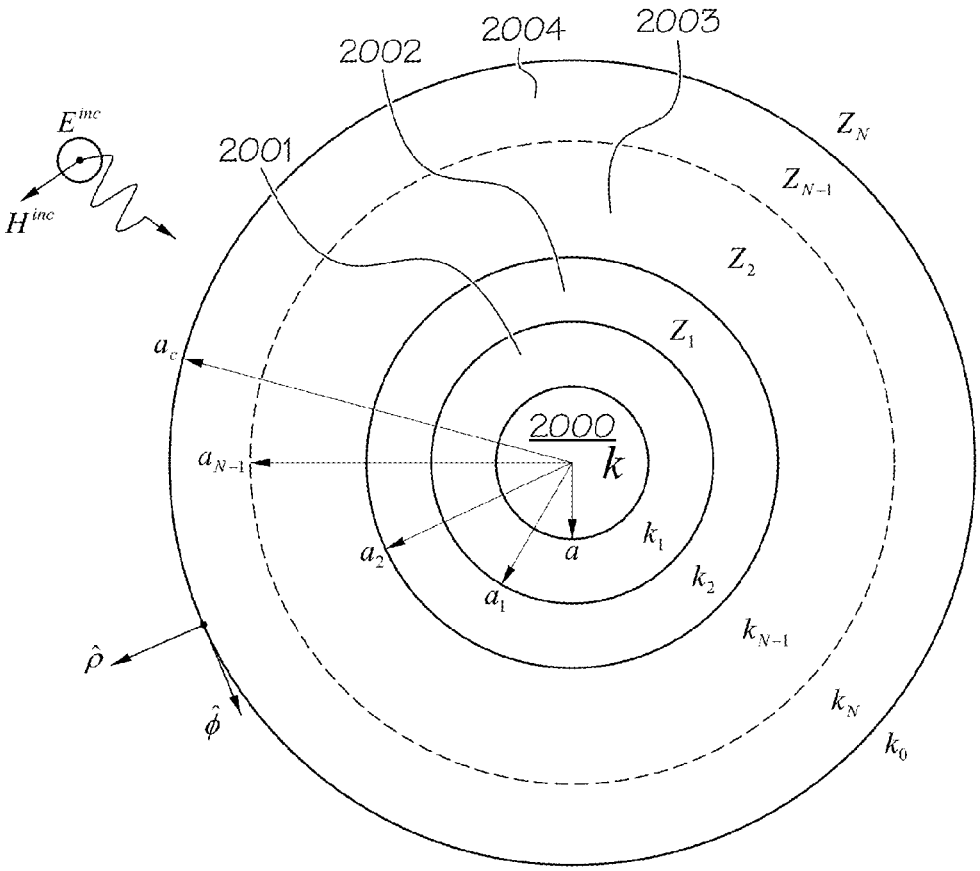
FIG. 20 is a general two-dimensional model of a conductive rod covered by N concentric magnetodielectric surfaces in accordance with an embodiment of the present invention.

Referring to FIG. 20, FIG. 20 is a general two-dimensional (2D) model of a magneto-dielectric rod 2000 surrounded by N concentric mantle surfaces in accordance with an embodiment of the present invention. In particular, FIG. 20 illustrates a magneto-dielectric rod 2000 surrounded by N concentric mantle layers 2001-2004 being illuminated by a transverse magnetic (TM)-polarized plane wave at normal incidence. It may be safe to assume that central rod 2000 and covers 2001-2004 are made of perfect electric conductors (PEC), due to the availability of good conductors, such as aluminum and copper at the frequencies of interest. The wavenumbers and wave impedances in each layer are $k_l,\eta_l$, where l indicates each region. A background medium is represented by $k_0,\eta_0$, and the 2D cylindrical obstacle is generally defined by $k,\eta$. The surface impedances are assumed to be scalar, and an $e^{j\omega t}$ time convention is used.

The total fields in each region may be generally expressed for both dielectric and conductive rods as $$E = \hat{z}E_0 \sum_n j^{-n} e^{jn\phi} \begin{cases} \upsilon_{0,n} J_n(k\rho), & \rho < a \\ \upsilon_{1,n} J_n(k_1\rho) + \upsilon_{2,n} Y_n(k_1\rho), & a < \rho < a_{c,1} \\ \vdots & \\ \upsilon_{2N-1,n} J_n(k_N\rho) + \upsilon_{2N,n} Y_n(k_N\rho), & a_{c,N-1} < \rho < a_{c,N} \\ J_n(k_0\rho) + c_n^{TM} H_n^{(2)}(k_0\rho), & \rho > a_{c,N} \end{cases} \tag{15}$$

and

-continued $$H = \hat{\phi}E_0 \sum_n j^{-n} e^{jn\phi} \begin{cases} \upsilon_{0,n}(j\eta)^{-1} J_n'(k\rho), & \rho < a \\ (j\eta_1)^{-1}[\upsilon_{1,n} J_n'(k_1\rho) + \upsilon_{2,n} Y_n'(k_1\rho)], & a < \rho < a_{c,1} \\ \vdots & \\ (j\eta_N)^{-1}\begin{bmatrix} \upsilon_{2N-1,n} J_n'(k_N\rho) + \\ \upsilon_{2N,n} Y_n'(k_N\rho) \end{bmatrix}, & a_{c,N-1} < \rho < a_{c,N} \\ (j\eta_0)^{-1}[J_n'(k_0\rho) + c_n^{TM} H_n'^{(2)}(k_0\rho)], & \rho > a_{c,N} \end{cases} \tag{16}$$

In EQs (15)-(16), $J_n(\xi)$ and $Y_n(\xi)$ are Bessel and Neumann functions of scattering order n, and the Hankel function is defined as $$H_n^{(2)}(\xi) = J_n(\xi) - jY_n(\xi).$$

In EQ (16), $$\psi_n'(\xi) = (d/d\xi)\psi_n(\xi).$$

At each interface, the continuity of the tangential electric fields and the scalar double-sided impedance boundary conditions are applied, yielding a 2 (N+1)×2 (N+1) system of equations, where N is the number of layers, such that $$E_z^l = E_z^{l-1} Z(H_\phi^l - H_\phi^{l-1}) \,|\, \rho \to a^{l-1}.$$

EQs. (15)-(16) form a complete description of the scattering for layered dielectric or conductive 2D cylindrical targets. Of particular importance is the case of perfect electric conducting (PEC) targets, for which $\in \to -j\infty$, $\mu \to 0$; perfect magnetic conductors (PMC) are also straightforwardly included using duality. The electric multipolar scattering coefficients, $c_n^{TM}$, can be succinctly written as $$c_n^{TM} = -U_n^{TM} / (U_n^{TM} - jV_n^{TM}),$$

where $U_n^{TM}$ and $V_n^{TM}$ are the determinants associated to the boundary-value problem. In the bilayer case, their expression is:

$$U_n^{TM} = \begin{vmatrix} J_n(ka) & J_n(k_1a) & Y_n(k_1a) & 0 & 0 & 0 \\ \frac{J_n'(ka)}{\eta} & \frac{J_n'(k_1a)}{\eta_1} & \frac{Y_n'(k_1a)}{\eta_1} & 0 & 0 & 0 \\ 0 & J_n(k_1a_{c,1}) & Y_n(k_1a_{c,1}) & J_n(k_2a_{c,1}) & Y_n(k_2a_{c,1}) & 0 \\ 0 & \begin{matrix} J_n(k_1a_{c,1}) + \\ \left(\frac{Z_1}{j\eta_1}\right)J_n'(k_1a_{c,1}) \end{matrix} & \begin{matrix} Y_n(k_1a_1) + \\ \left(\frac{Z_1}{j\eta_1}\right)Y_n'(ka_{c,1}) \end{matrix} & \left(\frac{Z_1}{j\eta_2}\right)J_n'(k_2a_{c,1}) & \left(\frac{Z_1}{j\eta_2}\right)Y_n'(k_2a_{c,1}) & 0 \\ 0 & 0 & 0 & J_n(k_2a_{c,2}) & Y_n(k_2a_{c,2}) & J_n(k_0a_{c,2}) \\ 0 & 0 & 0 & \begin{matrix} J_n(k_2a_{c,2}) + \\ \left(\frac{Z_2}{j\eta_2}\right)J_n'(k_2a_{c,2}) \end{matrix} & \begin{matrix} Y_n(k_2a_{c,2}) + \\ \left(\frac{Z_2}{j\eta_2}\right)Y_n'(k_2a_{c,2}) \end{matrix} & \left(\frac{Z_2}{j\eta_0}\right)J_n'(k_0a_{c,2}) \end{vmatrix}, \tag{17}$$

-continued $$V_n^{TM} = \begin{vmatrix} J_n(ka) & J_n(k_1 a) & Y_n(k_1 a) & 0 & 0 & 0 \\ \frac{J_n'(ka)}{\eta} & \frac{J_n'(k_1 a)}{\eta_1} & \frac{Y_n'(k_1 a)}{\eta_1} & 0 & 0 & 0 \\ 0 & J_n(k_1 a_{c,1}) & Y_n(k_1 a_{c,1}) & J_n(k_2 a_{c,1}) & Y_n(k_2 a_{c,1}) & 0 \\ 0 & \begin{matrix} J_n(k_1 a_{c,1}) + \\ \left(\frac{Z_1}{j\eta_1}\right) J_n'(k_1 a_{c,1}) \end{matrix} & \begin{matrix} Y_n(k_1 a_{c,1}) + \\ \left(\frac{Z_1}{j\eta_1}\right) Y_n'(k_1 a_{c,1}) \end{matrix} & \left(\frac{Z_1}{j\eta_2}\right) J_n'(k_2 a_{c,1}) & \left(\frac{Z_1}{j\eta_2}\right) Y_n'(k_2 a_{c,1}) & 0 \\ 0 & 0 & 0 & J_n(k_2 a_{c,2}) & Y_n(k a_{c,2}) & Y_n(k_0 a_{c,2}) \\ 0 & 0 & 0 & \begin{matrix} J_n(k_2 a_{c,2}) + \\ \left(\frac{Z_2}{j\eta_2}\right) J_n'(k_2 a_{c,2}) \end{matrix} & \begin{matrix} Y_n(k_2 a_{c,2}) + \\ \left(\frac{Z_2}{j\eta_2}\right) Y_n'(k_2 a_{c,2}) \end{matrix} & \left(\frac{Z_2}{j\eta_0}\right) Y_n'(k_0 a_{c,2}) \end{vmatrix}.$$

It is noted that the determinants $U_n^{TM}$ and $V_n^{TM}$ only differ by the last column, regardless of the number of layers. A complete N-layer expression is not provided herein for brevity, but may be derived without difficulty using EQs (15)-(16). The scattering width (SW) is defined in terms of each multipolar scattering coefficient $$\sigma_{2D} = (2\lambda_0/\pi) \sum_{n=0}^{N_{max}} |c_n^{TM}|^2 (2 - \delta_{n0}),$$

where $\delta_{n0}$ is the Kronecker delta, $N_{max}$ is the maximum relevant scattering order, and $\lambda_0$ is the free-space wavelength. EQs (15)-(16) provide the full recipe to analyze mantle cloaks consisting of N arbitrary impedance layers. Such N-layer covers may be used to cancel at least N scattering modes with possibilities of significantly reducing the scattering of electrically large obstacles.

Figure 21A:
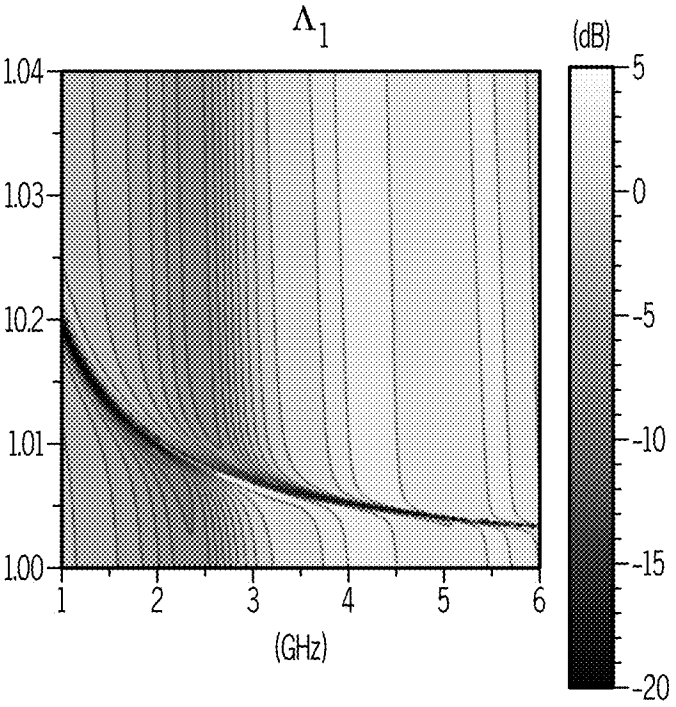
FIGS. 21A-21B illustrate the scattering efficiency across a large frequency band for bilayer cloaks tailored to sustain two zeros for the monopolar scattering, while varying the inner (left) and outer (right) aspect ratios with $X_{s,1}=-1.6\Omega$, $X_{s,2}=-113.7\Omega$ surface impedances in accordance with an embodiment of the present invention.
Figure 21B:
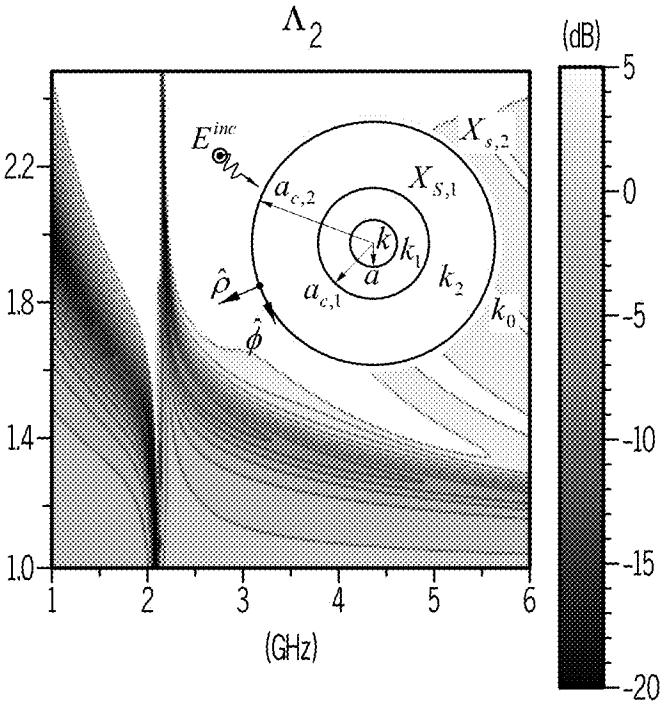
Figure 21C:
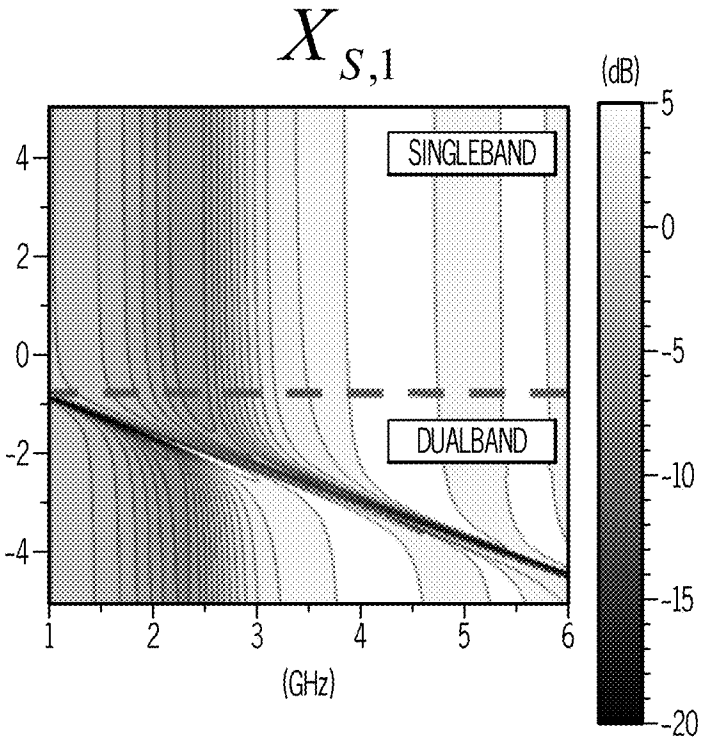
FIGS. 21C-21D illustrate the scattering efficiency across a large frequency band for bilayer cloaks tailored to sustain two zeros for the monopolar scattering, while varying the first impedance (left) with $X_{s,2}=-113.7\Omega$ surface impedance and the second impedance (right) with $X_{s,1}=-1.6\Omega$ surface impedance in accordance with an embodiment of the present invention.
Figure 21D:
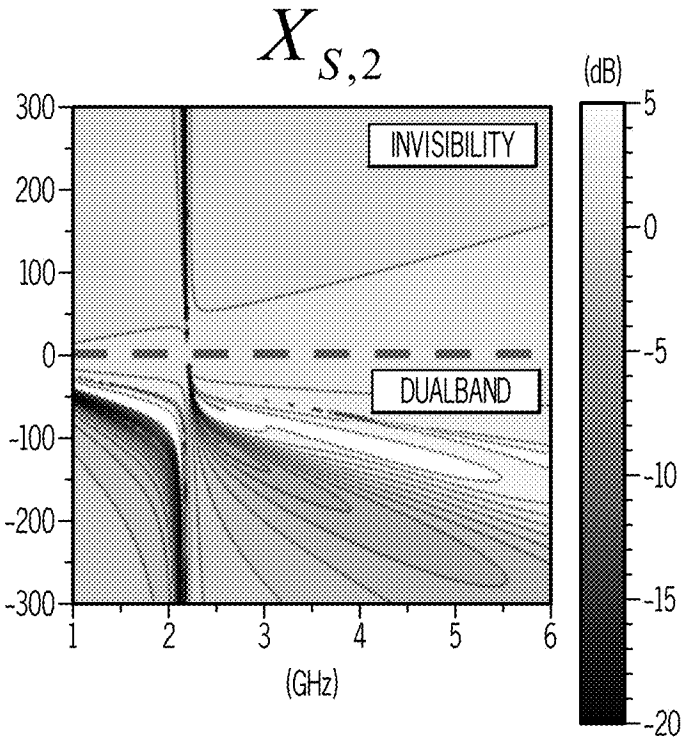

Multiband cloaking is naturally enabled using bilayer cloaks. As discussed herein, the principles of the present invention provide a large degree of flexibility of scattering dynamics across a wide bandwidth, which may be practically implemented with electronics for tunability. As discussed herein, a conductive target of cross-section $2a=\lambda_0/5$ is considered, where $\lambda_0$ is the wavelength at 3 GHz, as this represents a target of practical interest. Furthermore, the surface impedance values ($X_{s,1}=-1.6\Omega$, $X_{s,2}=-113.7\Omega$, it is noted herein that the surfaces are lossless) are calculated to simultaneously reduce the scattering at 2 GHz and 3 GHz with conformal aspect ratios $\Lambda_1 \equiv a_{c,1}/a=1.01$ and $\Lambda_2 \equiv a_{c,2}/a=1.50$, such that the overall covered object is still $2a_{c,2}=0.3/\lambda_0$. In this case, the effect of cancelling the monopolar term ($U_{0,0}^{TM}=0$) at both frequencies is considered. The effects of the inner and outer aspect ratios are studied in FIGS. 21A-21D. FIGS. 21A-21B illustrate the scattering efficiency across a large frequency band for bilayer cloaks tailored to sustain two zeros for the monopolar scattering, while varying the inner (left) and outer (right) aspect ratios with $X_{s,1}=-1.6\Omega$, $X_{s,2}=-113.7\Omega$ surface impedances in accordance with an embodiment of the present invention. FIGS. 21C-21D illustrate the scattering efficiency across a large frequency band for bilayer cloaks tailored to sustain two zeros for the monopolar scattering, while varying the first impedance (left) with $X_{s,2}=-113.7\Omega$ surface impedance and the second impedance (right) with $X_{s,1}=-1.6\Omega$ surface impedance in accordance with an embodiment of the present invention.

The scattering efficiency is defined as $Q_s \equiv \sigma_{2D,cov}/\sigma_{2D,bare}$. A sharp hyperbolic suppression is seen across the band which allows for dual-band operation for $1.005<\Lambda_1<1.02$. The curve for which the scattering is minimum defines a dual-band region, and for aspect ratios away from it, the bilayer cover acts as a single layer cover around 2.3 GHz. The second cover shows a more exotic behavior with a Fano-like response near 2.1 GHz. This line-shape is peculiar of the close occurrence of $U_n^{TM}=0$ and $V_n^{TM}=0$, and it arises because two scattering nulls need necessarily to be separated by a scattering resonance, consistent with Foster's reactance theorem applied to the scattering coefficients of moderately sized objects. The sharp scattering enhancement is associated with the scattering pole ($V_n^{TM}=0$) in between two closely spaced zeros ($U_n^{TM}=0$) created by the two covers, and it clearly becomes sharper as the zeroes are placed closer. Therefore, staggering zeros will not necessarily lead to an increased cloaking bandwidth, unless losses are considered to suppress the scattering peaks arising in between the zeros.

Cloaking Multiple Scattering Orders

The possibility of solutions to the dynamic equations in EQ (17) that may suppress at the same frequency more than one scattering order is considered. Considering FIG. 21D, by pairing capacitive and inductive covers together, one is able to approach near invisibility for conductive cylindrical targets of moderate cross-sections. A single mantle cloak has been shown to be effective at suppressing one scattering order of choice. Yet, a single cover may also adversely affect, or have no effect at all on higher-order scattering modes (HOMs), which may limit the cloaking bandwidth and the overall suppression level. By targeting the two most relevant terms at a given frequency, one may achieve scattering suppressions levels over 15 dB better than in previous designs for moderately sized objects. Solving $U_{0,1}^{TM}=0$ simultaneously at $f_0=3$ GHz, one finds surface reactances $$X_{s,1} = -11.2\ \Omega \text{ and } X_{s,2} = 348.4\ \Omega,$$

with aspect ratios $\Lambda_1=1.05$ and $\Lambda_2=2$, increasing the overall cover to $2a_{c,2}=0.4\lambda_0$.

Wideband Tunability and Cloaking Larger Cylinders

Using aspect ratios $\Lambda_1=1.05$ and $\Lambda_2=1.5$, one finds $X_{s,2}=694.3\Omega$, with $-4<X_{s,1}<-45\Omega$ for $1<f_0<12$ GHz to suppress $U_{1,2}^{TM}=0$ at the center of the band. Different from the dual-band operation in FIG. 21C, one may now suppress the scattering even for larger electrical cross-sections. These scattering modes are targeted as they are more relevant for $2a>0.6\lambda_0$, which can be verified by Mie theory. As one linearly changes $X_{s,1}$, one is able to dynamically change the required cloaking conditions across an ultra-wide bandwidth.

Mantle Cloaking of Finite-Length Rods

Figure 22:
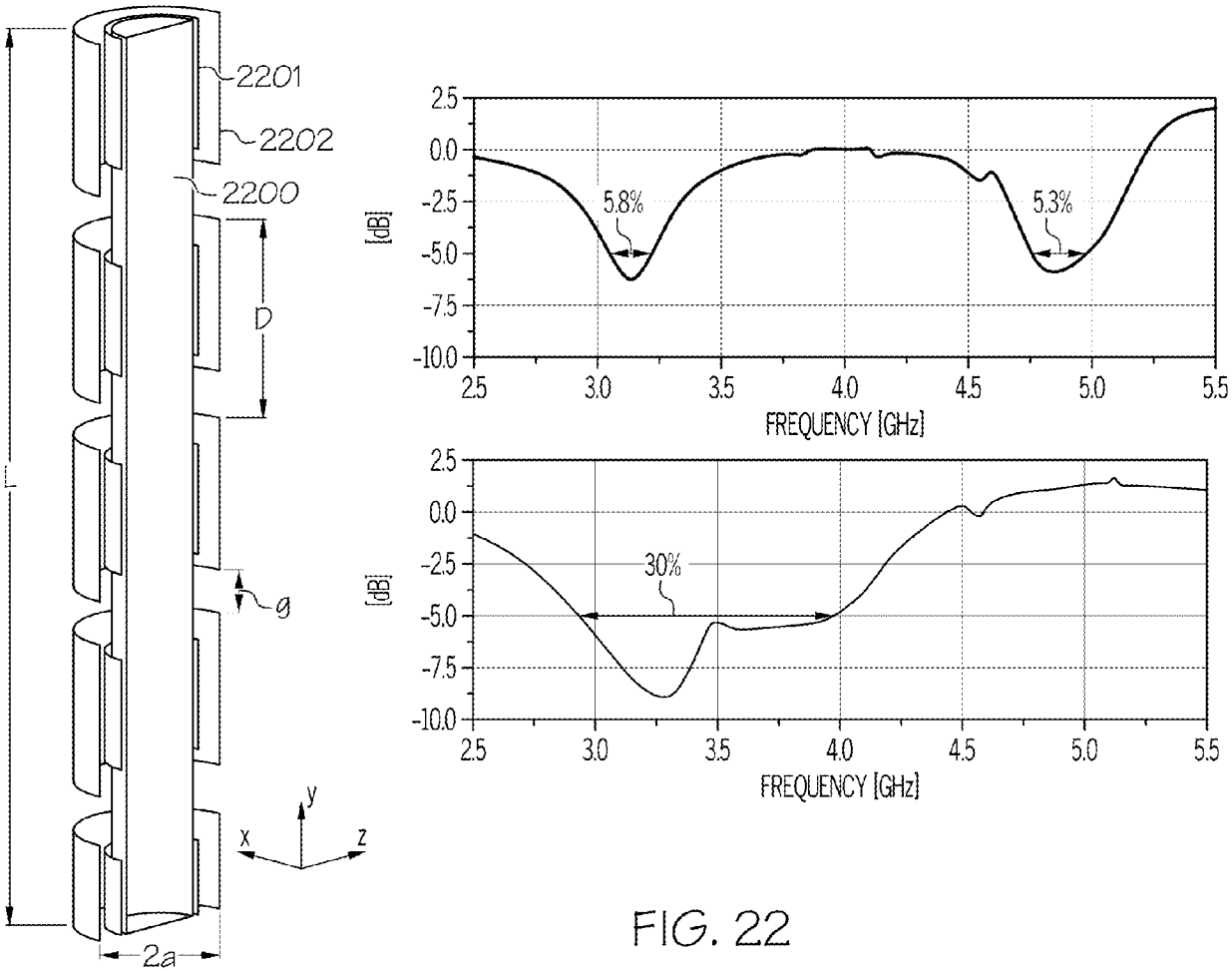
FIG. 22 illustrates the geometry of a conducting cylinder covered by a bilayer mantle cloak under $E_{inc}=\hat{y}E_0e^{j(\omega t-k_0x)}$ illumination for dual-band and wideband applications in accordance with an embodiment of the present invention.

Building on the theoretical results presented above, realistic bi-layer mantle cloaks to suppress the scattering from the finite-length conductive rod in FIG. 22 are now considered, with length L=180 mm and cross-section 2a=19.05 mm. FIG. 22 illustrates the geometry of a conducting cylinder 2200 covered by a bilayer mantle cloak under $$E_{inc} = \hat{y}E_0 e^{j(\omega t - k_0 z)}$$

illumination in accordance with an embodiment of the present invention. FIG. 22 further illustrates the dual band operation (top) and wideband operation (bottom).

Referring to FIG. 22, rod 2200 is covered by two ultrathin patterned surfaces 2201, 2202 tailored to suppress the scattering signature of the object in different frequency bands. Each cover 2201, 2202 is separated from rod 2200 by air, which may be practically implemented using thin plastic spacers at each end. In one embodiment, covers 2201, 2202 are separated from rod 2200 via a dielectric material. While dielectric substrates and superstrates may be used as additional degrees of freedom in the design, air spacers are considered here to limit losses, weight and cost. The typical design process for a single cover starts from the analytical designs developed above and it then consists in optimizing the effective surface impedance around the analytical design to minimize the total scattering cross-section (SCS) integrated at all viewing angles, either in terms of maximum bandwidth below a certain acceptable scattering level, or to achieve the maximum scattering suppression at a single frequency. The two objectives are generally mutually exclusive. In general, consistent with the previous discussion, a more conformal capacitive surface, closer to the surface of the conductive rod to be cloaked, leads to stronger scattering suppression at the cost of bandwidth, while larger separation between the cloak and the object leads to a smoother scattering profile with a broader cloaking bandwidth. Using a bi-layer mantle cloak, made of two capacitive impedances with optimal values, provides further degrees of freedom, based on which one may be able to push down the overall scattering suppression while at the same time broadening the bandwidth around the central frequency. Bi-layer mantle cloaks may also be optimized to produce dual-band cloaking operation with significant scattering suppression over two moderate bandwidth ranges as highlighted above.

For dual-band operation (top panel in FIG. 22), each of the covers 2201, 2202 are chosen to be very low profile, with small spacers $\Lambda_1=\Lambda_2=1.2$. To realize the two required capacitive surfaces, air-backed horizontal strip surfaces were implemented with effective shunt surface impedances $$X_s = -\pi\left(2\omega\varepsilon_0 D \ln\left[\csc\left(\frac{\pi w}{2D}\right)\right]\right)^{-1}.$$

However, it is noted that the surface impedance is in general more complex, by noting the proximity of the layers to each other and the rod itself. As shown in FIG. 22, D is the period of conductive horizontal strips of width w. The surfaces are denoted as $D_x$, $w_x$, and $X_{s,x}$, where x=1 is the inner surface and x=2 is the outer surface. Using horizontal strip metasurfaces, dual-band operation is shown across a large bandwidth, where $D_1$=37 mm, $w_1$=0.8 mm ($X_{s,1}$=−72.1Ω); $D_2$=36.2 mm, $w_2$=10 mm ($X_{s,2}$=−185.7Ω). As illustrated in FIG. 22, the scattering suppression is approximately 76% at frequencies $f_1$=3.13 GHz and $f_2$=4.85 GHz, with moderate bandwidths. The bandwidth at each design frequency is below 6%, measured at a 5 dB total scattering suppression level, which is competitive compared to other passive 3D cloaking strategies. Consistent with the analytical results discussed above, the two bands are separated by a region of overall increased scattering. This cloak design can be easily reconfigured for a desired set of bands, either physically or electronically. By tailoring the distance between each layer relative to the bare rod and the capacitive values of each of the surfaces, one may successfully tune the dual band response across the band 2.5-5.5 GHz.

By optimizing the cloaks, one can realize the response shown in the bottom panel of FIG. 22, for which one finds 87% total SCS suppression at 3.3 GHz and a 5 dB fractional bandwidth of over 30%. As discussed above, one may match the nullification condition for multiple dominant scattering terms better using this combination of capacitive covers. In this case, the innermost cover is separated by the rod with an aspect ratio $\Lambda_1$=1.18, and the second with $\Lambda_2$=1.68. The period and gap of the innermost cloak are $D_1$=45.4 mm and $w_1$=19.3 mm ($X_{s,1}$=−393.4Ω), respectively, while the period and gap of the second layer are $D_2$=41.2 mm and $w_2$=10.9 mm ($X_{s,1}$=229.1Ω), respectively. The outermost cover is responsible for the majority of the cloaking bandwidth and suppression, but by itself would show larger 2 dB scattering ripples above 3.5 GHz. However, in this design, the innermost conformal impedance surface flattens out these deviations to increase the 5 dB bandwidth by an additional 400 MHz. Compared to previous single-layer mantle cloak designs, these results show a substantially improved bandwidth, of over nine times the 5 dB fractional bandwidth. These findings are also fully consistent with cloaking limits, where stronger scattering suppression of targets of moderate cross section necessarily limits the bandwidth. In this optimized design, one is able to merge both characteristics of good scattering suppression with a shallower wideband response.

Figure 23:
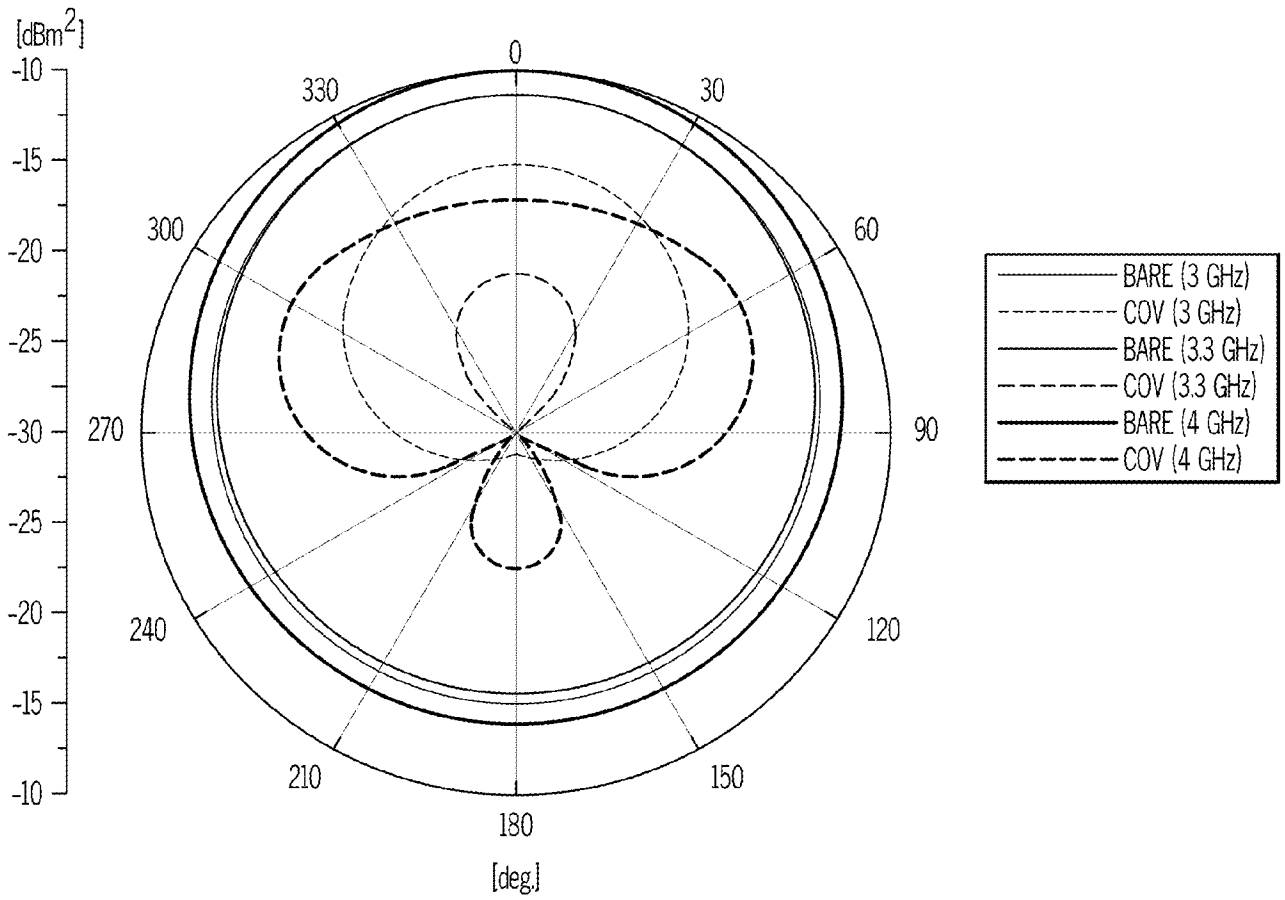
FIG. 23 illustrates the H-plane scattering pattern for the bare and covered cylinders considering the wideband cloak design of FIG. 22 in accordance with an embodiment of the present invention.
Figure 24:
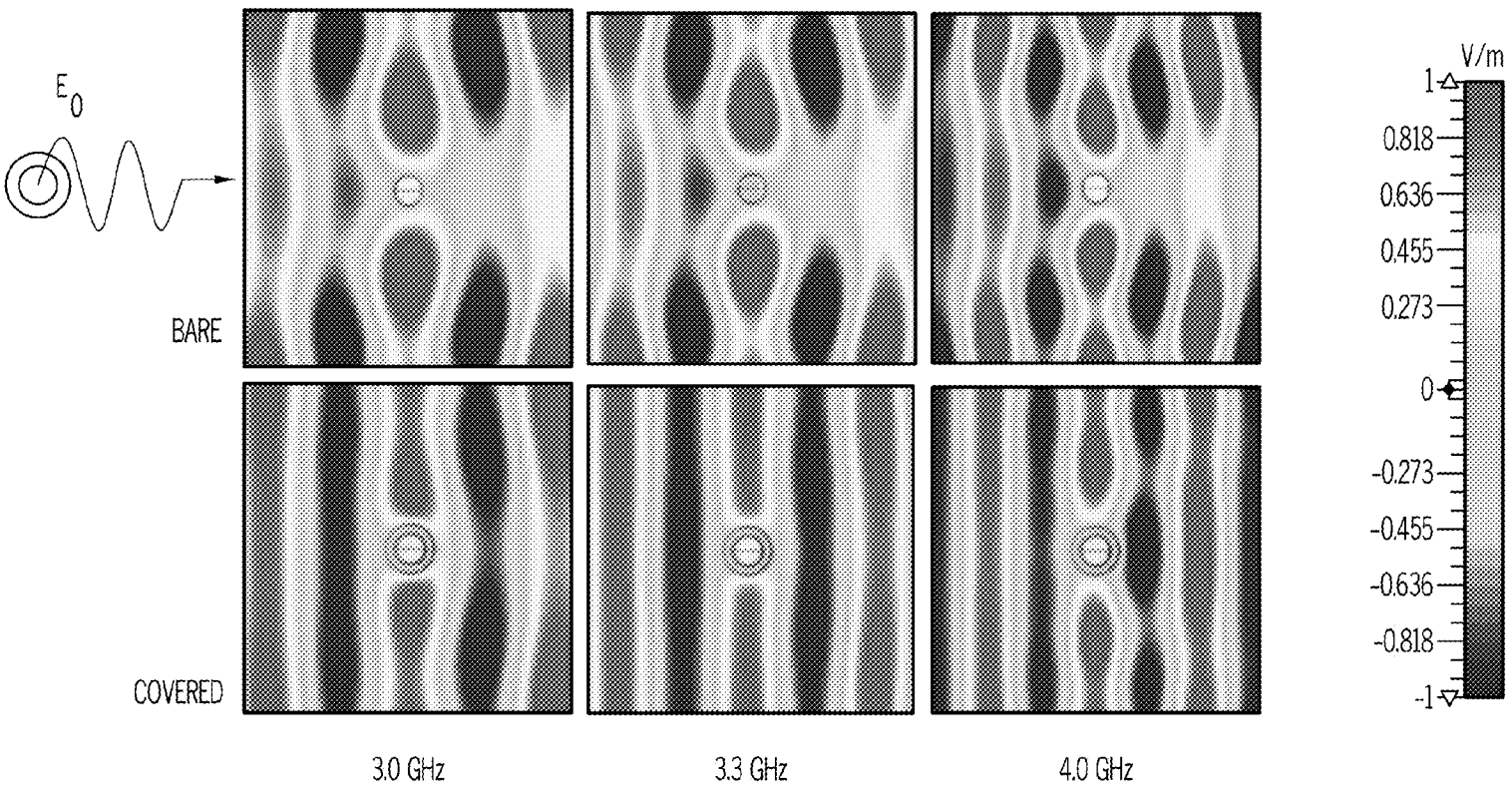
FIG. 24 illustrates the snapshots in time of $E_{total,y}$ for the bilayer cloak for broadband operation in accordance with an embodiment of the present invention.

The broadband scattering suppression along the most relevant H-plane for this second design shown in FIG. 23 is now considered. FIG. 23 illustrates the H-plane scattering pattern for the bare and covered cylinders considering the wideband cloak design of FIG. 22 in accordance with an embodiment of the present invention. A logarithmic scale is used in FIG. 23 to highlight the residual scattering profiles on the same scale of the bare scenario, and three separate frequencies are considered across the bandwidth of interest. At all three considered frequencies, the backscattering is largely cancelled, with the exception of 4 GHz, for which still an 8 dB overall suppression is observed. The most striking operation is observed at 3.3 GHz, for which the backscattering is suppressed by nearly 30 dB and the forward scattering is suppressed by over 10 dB, which leaves a residual scattering profile largely directed in the forward direction and a total integrated SCS suppression of 9 dB. Referring to FIG. 24, FIG. 24 illustrates the snapshots in time of $E_{total,y}$ for the bilayer cloak for broadband operation in accordance with an embodiment of the present invention. As illustrated in FIG. 24, FIG. 24 clearly demonstrates the lack of backscattering and low residual scattering in the H-plane with near-field restoration of the incident field using the realistic bi-layer cover.

At all frequencies, the bare finite-length cylinder shows a strong scattering response all around the object due to the interaction of the rod with the incident plane wave in accordance with the omnidirectional scattering patterns in FIG. 23. A shadow region is clearly seen behind the bare rod at each frequency. The bi-layer cloak noticeably shows a much improved and only moderately perturbed field distribution all around the covered rod including the shadow region over the entire 1 GHz band considered here. The field at 3.3 GHz is the most remarkable, for which the incident field is almost completely restored, with only a marginal shadow disturbance, consistent with FIG. 23.

Multi-Layer Mantle Cloaks Applied to Non-Canonical or Collections of Objects

Figure 25:
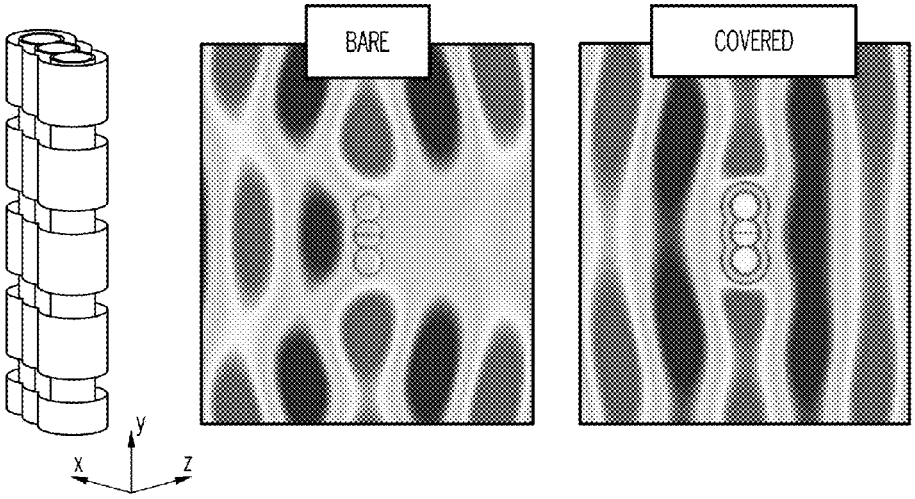
FIG. 25 illustrates the geometry of three merged rods with a bilayer cover along with a snapshot in time of the H-plane axial-polarized total electric field at 3.3 GHz in accordance with an embodiment of the present invention.

As discussed herein, this ultra-low profile cloaking technique may be also extended to collections of objects or complex objects with larger cross-sections obtained by merging the cloaked rods demonstrated previously. Since the designed cloaks appear to operate well also in the very near-field of the object, it is expected that their functionality may be preserved after combining together multiple objects covered with the proposed cloaks. FIG. 25 demonstrates such a concept for the case of an object of transverse length $0.6\lambda_0$ at 3.3 GHz formed by combining three rods as the ones analyzed above. In particular, FIG. 25 illustrates the geometry of three merged rods with a bilayer cover along with a snapshot in time of the H-plane axial-polarized total electric field at 3.3 GHz in accordance with an embodiment of the present invention. The conformal cover for each rod is exactly the same as the one optimized above for a single rod, but obviously merged with the other cloaks in the regions in which the covers intersect. Despite the lack of a new optimization for this more complex scenario, and despite the size of the object, with an overall cross-sectional area of $1.25\lambda_0^2$ at 3.3 GHz, the incident field is largely restored by the cloaks. In the bare scenario, a large shadow is created on the back of the obstacle, which is largely suppressed by the cloaks, together with minimized reflections. A 4.6 dB suppression of the total integrated field at 3.3 GHz is measured with a 3 dB bandwidth of 18%.

Figure 26:
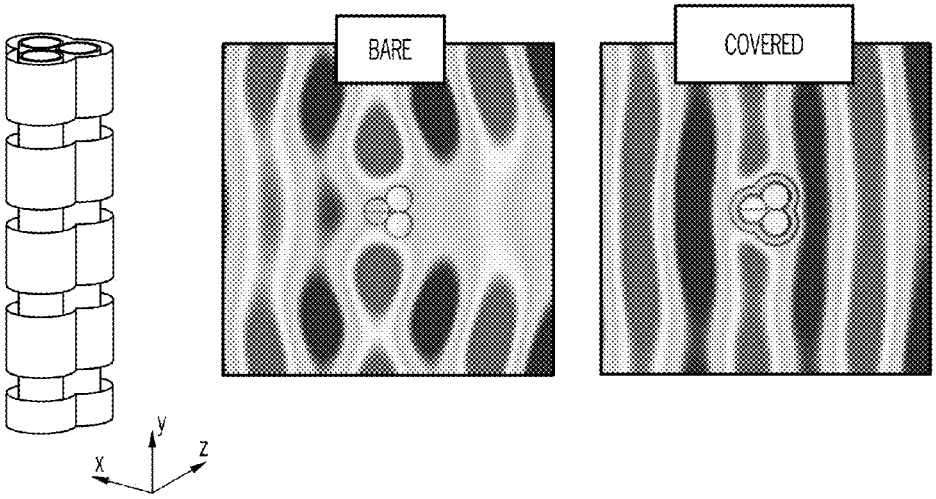
FIG. 26 illustrates the field distributions at 3.6 GHz for a triangular complex object formed by combining the rods in a different lattice configuration in comparison to FIG. 25 in accordance with an embodiment of the present invention.
Figure 27:
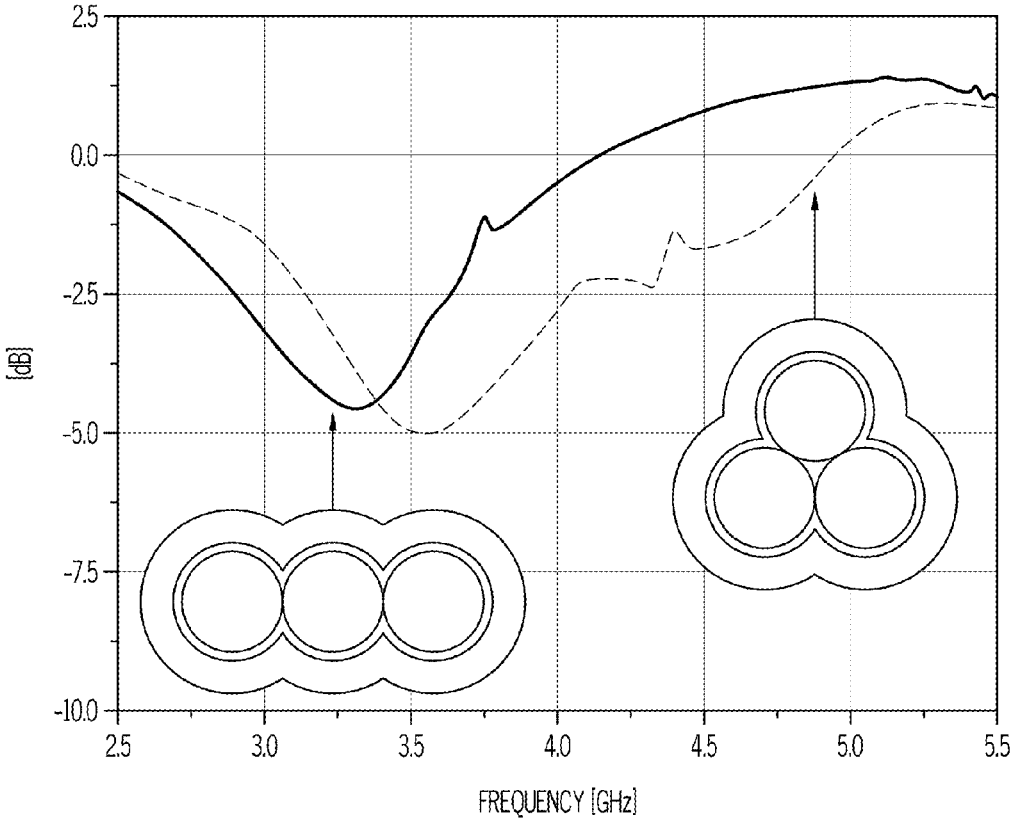
FIG. 27 illustrates the total scattering suppression versus frequency for the two complex geometries of FIGS. 25 and 26 in accordance with an embodiment of the present invention.

In order to show the robustness of the cloaking performance, a different arrangement of the rods is considered to form the triangular object shown in FIG. 26. FIG. 26 illustrates the field distributions at 3.6 GHz for a triangular complex object formed by combining the rods in a different lattice configuration in comparison to FIG. 25 in accordance with an embodiment of the present invention. Referring to FIG. 26, it is seen that the cloaking performance is again fairly well maintained in this complex scenario, but now the strong coupling among objects, which are touching each other and positioned in an asymmetric configuration compared to the impinging wave, slightly shifts the cloaking effect up in frequency to 3.6 GHz and with a slightly deeper (5 dB) and wider 3 dB fractional bandwidth (22%) suppression band compared to the geometry of FIG. 25. This is seen in the total SCS suppression for the two non-canonical geometries shown in FIG. 27. FIG. 27 illustrates the total scattering suppression versus frequency for the two complex geometries of FIGS. 25 and 26 in accordance with an embodiment of the present invention. Even in this case, near-field and far-field simulations confirm the successful operation of the conformal cloaks for broadband scattering reduction.

Hence, the mantle cloaking technique has been extended to bi-layers or multi-layers, where such implementation provides extended bandwidth of operation as compared to single-layer mantle cloaks. By adding additional impedance surfaces, one is able to improve the scattering suppression and extend the bandwidth of operation, or engineer dual-band scatterings suppression. Furthermore, it has been shown that such bi-layer or multi-layer cloaks may be wrapped around more complex geometries due the ultra-thin patterning on thin flexible substrates. It is envisioned that such bi-layer/multi-layer cloaks may be loaded with tunable electronics, such as varactor diodes, to tune the desired frequency response at will in real time. In addition to radar camouflaging, antennas and sensor applications may benefit from this approach since these conformal and reconfigurable designs may help to block congested frequency band requirements in crowded or cluttered environments. The field penetration enabled by these cloaks may also be used to reduce the scattering from nearby antenna elements yet retaining their capability to transmit and receive signals. In these scenarios, the antenna input impedance and directivity have been shown to be restored to that of the isolated geometries. The bi-layer cloaks support suppression levels, bandwidth and reconfigurability that may be of great use for practical antenna applications in demanding environments.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A communication system, comprising:

a first antenna radiating in a first frequency band, wherein said first antenna is covered by a conformal mantle metasurface with anti-phase scattering properties; and a second antenna radiating in a second frequency band;

wherein said conformal mantle metasurface is a patterned metallic sheet comprising an array of rectangular patches formed by slits both in an azimuthal and a vertical direction aimed at reducing both vertical and horizontal polarization scattering, wherein said conformal mantle metasurface is configured to cancel scattering in said second frequency band.

2. The communication system as recited in claim 1, wherein a vertical cut is introduced in said patterned metallic sheet regularly in said azimuthal direction.

3. The communication system as recited in claim 1, wherein said first antenna comprises a low-band dipole antenna, wherein said second antenna comprises a high-band dipole antenna.

4. The communication system as recited in claim 1, wherein said first and second antennas comprise one of the following: patch antennas, satellite antennas, parabolic dishes and horns.

5. The communication system as recited in claim 1, wherein said conformal mantle metasurface comprises a first layer and a second layer.

6. The communication system as recited in claim 5, wherein said first and second layers are separated from said first antenna by air.

7. The communication system as recited in claim 5, wherein said first and second layers are separated from said first antenna by a dielectric.

8. The communication system as recited in claim 5, wherein said first layer targets scattering reduction for said first frequency band, wherein said second layer targets scattering reduction for said second frequency band.

9. The communication system as recited in claim 8, wherein said first and second frequency bands are converged to a single broadband range based on modifying a period and a gap of said first and second layers as well as based on modifying a distance said first and second layers are from said first antenna.

10. The communication system as recited in claim 5, wherein said first and second layers form a capacitive impedance surface.

11. The communication system as recited in claim 5, wherein said first and second layers are loaded with tunable electronics.

12. A communication system, comprising:

a first antenna radiating in a first frequency band, wherein said first antenna is covered by a conformal mantle metasurface with anti-phase scattering properties; and a second antenna radiating in a second frequency band;

wherein said conformal mantle metasurface is a horizontal-strip capacitive surface, wherein said conformal mantle metasurface is configured to cancel scattering in said second frequency band.

13. A communication system, comprising:

a first antenna radiating in a first frequency band, wherein said first antenna is covered by a conformal mantle metasurface with anti-phase scattering properties; and a second antenna radiating in a second frequency band;

wherein said conformal mantle metasurface is characterized by a rectangular unit-cell with horizontal and vertical slits to exhibit a negative value of a surface reactance for transverse-magnetic and transverse-electric polarization, respectively, wherein said conformal mantle metasurface is configured to cancel scattering in said second frequency band.

* * * * *